US011187039B2

(12) United States Patent
Moreno Moncada

(10) Patent No.: US 11,187,039 B2
(45) Date of Patent: Nov. 30, 2021

(54) CONFIGURABLE LADDER SYSTEM AND METHOD

(71) Applicant: LOUISVILLE LADDER INC., Louisville, KY (US)

(72) Inventor: Francisco Javier Moreno Moncada, Nuevo León C.P. (MX)

(73) Assignee: LOUISVILLE LADDER INC., Louisville, KY (US)

( * ) Notice: Subject to any disclaimer, the term of this patent is extended or adjusted under 35 U.S.C. 154(b) by 284 days.

(21) Appl. No.: 16/534,358

(22) Filed: Aug. 7, 2019

(65) Prior Publication Data

US 2020/0048962 A1 Feb. 13, 2020

Related U.S. Application Data

(60) Provisional application No. 62/716,778, filed on Aug. 9, 2018.

(51) Int. Cl.
*E06C 7/18* (2006.01)
*E06C 7/48* (2006.01)
(Continued)

(52) U.S. Cl.
CPC ..... *E06C 7/18* (2013.01); *E06C 1/08* (2013.01); *E06C 1/14* (2013.01); *E06C 7/48* (2013.01)

(58) Field of Classification Search
CPC ... E06C 7/14; E06C 7/165; E06C 7/48; E06C 1/02; E06C 1/04; E06C 1/06; E06C 1/08; E06C 1/14; E06C 7/18
See application file for complete search history.

(56) References Cited

U.S. PATENT DOCUMENTS 5,101,932 A 4/1992 Trudgeon
5,573,081 A * 11/1996 Bartnicki ..... E06C 7/14 182/129
(Continued)

FOREIGN PATENT DOCUMENTS

CN 207228983 U 4/2018
WO WO 2012/115963 A2 8/2012

OTHER PUBLICATIONS

Examination Search Report, Application No. 3,051,424, dated Feb. 12, 2021.

*Primary Examiner* — Alvin C Chin-Shue
*Assistant Examiner* — Shiref M Mekhaeil
(74) *Attorney, Agent, or Firm* — Orrick, Herrington & Sutcliffe LLP

(57) ABSTRACT

A configurable ladder system that can be configured into any of a plurality of different ladder configuration modes and methods for manufacturing and using same. The configurable ladder system includes at least one side rail and at least one support member and can be configured into any of a plurality of different ladder configuration modes. Each support member is disposed on a relevant side rail or on an optional adjustable rail. Depending upon a selected ladder configuration mode of the configurable ladder system, two or more of the support members can be configured to engage respective support regions within an intended work environment of the configurable ladder system. Thereby, the configurable ladder system advantageously can be readily adapted for use within a wide range of different purposes within a large number of a different work environments while enhancing user safety.

15 Claims, 33 Drawing Sheets

(51) Int. Cl.
*E06C 1/14* (2006.01)
*E06C 1/08* (2006.01)

(56) References Cited

U.S. PATENT DOCUMENTS 5,850,894 A * 12/1998 Busenhart ..... E06C 7/48 182/214
6,390,238 B1 * 5/2002 Gibson ..... E06C 1/387 182/129
6,427,805 B1 * 8/2002 Gibson ..... E06C 1/387 182/165
6,443,261 B1 * 9/2002 Gibson ..... E06C 1/16 182/104
6,698,699 B1 * 3/2004 Bailey ..... E06C 1/39 182/129
6,823,998 B2 * 11/2004 Fabregas ..... B25H 3/06 206/373
7,108,103 B2 * 9/2006 Meeker ..... E06C 1/393 182/165
D549,356 S * 8/2007 Gibson ..... D25/68
7,753,170 B1 * 7/2010 Gibson ..... E06C 7/48 182/107
8,776,947 B1 * 7/2014 Wurth ..... E06C 1/12 182/1
9,593,531 B2 3/2017 Ballard et al.
9,797,194 B2 10/2017 Moss et al.
D835,807 S * 12/2018 Lentine ..... D25/69
D899,628 S * 10/2020 Moncada ..... D25/64
D905,869 S * 12/2020 Lentine ..... D25/68
2005/0284703 A1 12/2005 Deuer
2007/0181367 A1 * 8/2007 Astor ..... E06C 7/14 182/129
2007/0181369 A1 * 8/2007 Gibson ..... E06C 7/14 182/165
2007/0284192 A1 * 12/2007 Meyers ..... E06C 1/387 182/129
2008/0017447 A1 * 1/2008 Sheridan ..... E06C 7/482 182/107
2008/0083583 A1 * 4/2008 Gibson ..... E06C 7/482 182/108
2008/0302604 A1 12/2008 Kramer
2009/0283361 A1 * 11/2009 Gibson ..... E06C 7/48 182/129
2010/0006374 A1 * 1/2010 Gabriel ..... E06C 7/165 182/116
2012/0024630 A1 * 2/2012 VanLaningham ..... A01M 31/02 182/116
2012/0266436 A1 * 10/2012 Rittmann ..... E06C 7/48 29/428
2013/0048427 A1 * 2/2013 Sordo ..... F16M 11/14 182/110
2013/0146394 A1 * 6/2013 Astor ..... E06C 7/14 182/129
2014/0224585 A1 * 8/2014 Russell ..... E06C 7/082 182/116
2014/0332316 A1 * 11/2014 Tiber ..... E06C 7/46 182/129
2014/0367194 A1 12/2014 Bolinski et al.
2015/0090533 A1 * 4/2015 Moss ..... E06C 7/46 182/180.1
2015/0159434 A1 * 6/2015 Leng ..... E06C 7/50 182/163
2015/0308190 A1 * 10/2015 Skubic ..... E06C 1/393 182/124
2016/0348434 A1 * 12/2016 Williams ..... E06C 7/14
2017/0030142 A1 2/2017 Russell et al.
2017/0130529 A1 * 5/2017 Tamez Reyes ..... E06C 1/12
2017/0234069 A1 * 8/2017 Pfeifer ..... E06C 7/14 248/238
2017/0328131 A1 * 11/2017 Woodward ..... E06C 1/20
2018/0171714 A1 * 6/2018 Dings ..... E06C 1/387
2018/0187488 A1 * 7/2018 Mora ..... E06C 7/482
2018/0187489 A1 * 7/2018 Parker ..... E06C 1/04
2019/0145171 A1 * 5/2019 Frensley ..... E06C 7/165 182/120
2019/0264505 A1 * 8/2019 Dangrow ..... E06C 7/14
2020/0240209 A1 * 7/2020 Zhu ..... E06C 7/50
2020/0378183 A1 * 12/2020 Zhu ..... E06C 7/50
2020/0386050 A1 * 12/2020 Mittanck ..... E06C 1/383
2021/0246725 A1 * 8/2021 Wernberg ..... E06C 7/14

* cited by examiner

CONFIGURABLE LADDER SYSTEM AND METHOD

CROSS- REFERENCE TO RELATED APPLICATIONS

This application claims the benefit of, and priority to, U.S. Provisional application Ser. No. 62/716,778, filed Aug. 9, 2018, the disclosure of which is hereby incorporated herein by reference in its entirety and for all purposes.

FIELD

The disclosed embodiments relate generally to ladder systems and more particularly, but not exclusively, to fall prevention systems suitable for use with ladders and other elevated platforms.

BACKGROUND

Falls are a leading cause of injuries and effect millions of people every year. Many of these falls involve use of a ladder. Despite being considered basic tools, ladders are inherently dangerous. Some people may discount the dangerous nature of the ladders and thus can fall and suffer serious injuries, or even death. To help prevent falls, some ladders include cable hooks or other safety systems for stabilizing the ladders. These safety systems do little to aid a user who assumes an awkward or otherwise precarious physical stance when balancing upon the narrow rungs of conventional ladders, particularly while using one or both hands to perform a task.

In view of the foregoing, a need exists for an improved ladder system and method for preventing falls that overcome the aforementioned obstacles and deficiencies of currently-available ladder systems.

Figure 1B:
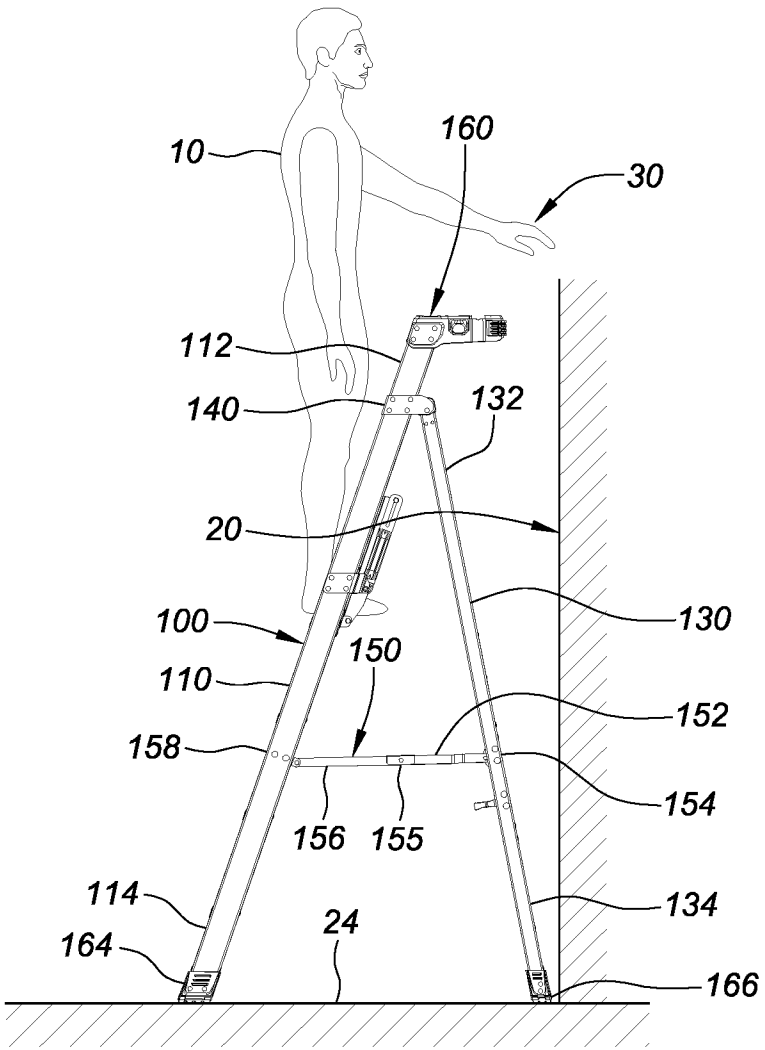
FIG. 1B is an exemplary top-level block diagram illustrating a right-side view of an alternative embodiment of the convertible ladder system of FIG. 1A, wherein the convertible ladder system is disposed in a step ladder configuration.

It should be noted that the figures are not drawn to scale and that elements of similar structures or functions are generally represented by like reference numerals for illustrative purposes throughout the figures. It also should be noted that the figures are only intended to facilitate the description of the preferred embodiments. The figures do not illustrate every aspect of the described embodiments and do not limit the scope of the present disclosure.

DETAILED DESCRIPTION OF THE PREFERRED EMBODIMENTS

Figure 1A:
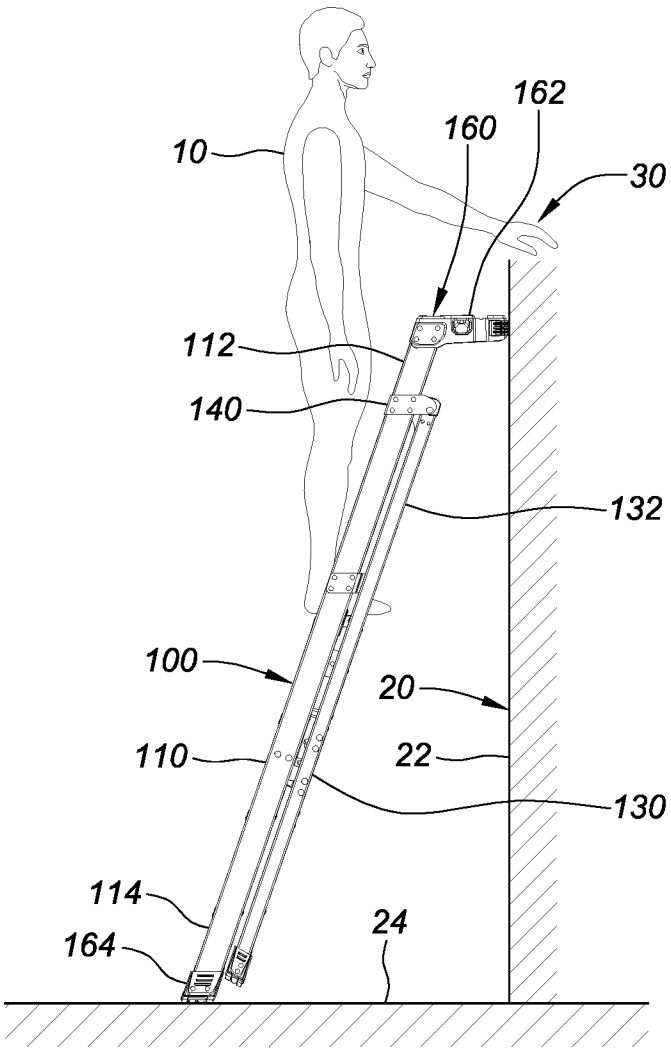
FIG. 1A is an exemplary top-level block diagram illustrating a right-side view of an embodiment of a convertible (or combination) ladder system disposed in a shelf ladder configuration.

Since currently-available ladder safety systems do little to aid a user who assumes an awkward or otherwise precarious physical stance while balancing upon narrow ladder rungs, a safety system and method for preventing falls from ladders and other elevated platforms can prove desirable and provide a basis for a wide range of applications, such as extension ladders, step ladders, platform ladders, shelf ladders, etc. This result can be achieved, according to one embodiment disclosed herein, by an elongated rigid structure, such as a configurable (or convertible) ladder system 100, as illustrated in FIGS. 1A-B. For Turning to FIG. 1A, for example, the configurable ladder system 100 is shown as including at least one side rail 110 and at least one support member 160. Each support member 160 can be associated with a respective side rail 110. In other words, a selected support member 160 can be associated with one or more side rails 110. The selected support member 160 can span between, and couple with, a pair of side rails 110 in selected embodiments. Alternatively and/or additionally, a selected side rail 110 can be associated with one or more support members 160. The one or more support members 160, for example, can be disposed along a selected dimension of the selected side rail 110.

Each side rail 110 can comprise an elongated structure with an upper end region 112 and a lower end region 114 that is opposite the upper end region 112. In selected embodiments, the side rails 110 can comprise at least one pair of side rails 110 that are separated by a predetermined distance. One or more rungs (cross-members or cross pieces) 120 (shown in FIG. 12) can be disposed between, and couple, the paired side rails 110. In selected embodiments, the rungs 120 can be disposed between the side rails 110 with a predetermined spacing. The predetermined spacing can be uniform and/or different between selected adjacent rungs 120. The side rails 110 and/or the rungs 120 can be made of aluminum, steel, fiberglass, plastic, wood, a composite and/or any other material of suitable strength and durability, without limitation.

A first support member 162 can be disposed at the upper end region 112; whereas, a second support member 164 can be disposed at the lower end region 114. Stated somewhat differently, the side rail 110 can be disposed between the first support member 162 and the second support member 164. The support members 160 can be coupled with the side rail 110 in any conventional manner and preferably are fixedly coupled with the side rail 110. In some embodiments, the side rails 110 can engage the support members 160 via one or more fasteners (not shown), an adhesive, double-sided tape and/or a press (or interference) fit between the relevant support member 160 and the side rail 110.

The support members 160 advantageously can provide physical support for the configurable ladder system 100 during use. Each support member 160 can be configured to engage a selected support region 20 within an intended work environment of the configurable ladder system 100. The first support member 162, for example, can be configured to engage an elevated support region 22, such as adjacent to an elevated work location 30, within the work environment, and/or the second support member 164 can be configured to engage a base support region 24, such as a floor, ground or other lower support region, of the work environment. One or more of the support members 160 can provide a support profile that conforms with, and engage, a predetermined feature of the support region 20, which is sufficiently rigid or otherwise sturdy to provide support for a user 10 and any tools, workpieces and other equipment while using the configurable ladder system 100.

Exemplary predetermined features can include, but are not limited to, a flat (or planar) surface (or periphery) 20B (shown in FIG. 3B), a rectangular surface (or periphery), a square surface (or periphery), an inside (or concave) surface (or periphery) 20A (shown in FIG. 3A), an outside (or convex) corner 20C (shown in FIG. 3C), a concave round surface (or periphery), a convex round surface (or periphery) 20D (shown in FIG. 5), a pole and/or a board 20E-H (shown in FIGS. 6-9). In selected embodiments, the support profile of a selected support member 160 can conform with a plurality of different and/or similar predetermined features. Stated somewhat differently, the selected support member 160 advantageously can be provided with any predetermined shape, size and/or dimension for engaging a wide variety of support regions 20 with different and/or similar geometries.

Additionally and/or alternatively, one or more of the support members 160 can provide a non-skid interface for securing an engagement between the configurable ladder system 100 and the relevant support region(s) 20. The support members 160, for example, can be at least partially lined with (or otherwise comprise) a non-skid surface material. The non-skid surface material can include any suitable material that provide a high coefficient of friction with the relevant support region(s) 20. Exemplary suitable materials can include, but are not limited to, neoprene, ethylene propylene diene monomer (M-class) rubber (EPDM rubber), polyvinyl chloride (PVC) foam, polyethylene, sponge rubber, silicone foam, urethane, cork, rubber, felt, acrylic, polyester, styrene-butadiene or styrene-butadiene rubber (SBR), or a combination thereof. The non-skid surface material can be uniform and/or different among the support members 160 and advantageously can reduce and/or eliminate any relative slipping and/or sliding motion between the support members 160 and the relevant support regions 20, improving a stability of the configurable ladder system 100 during use can advantageously be improved.

As illustrated in FIG. 1A, the configurable ladder system 100 can be configured into a shelf ladder mode. The configurable ladder system 100, in other words, can be configured for use as a shelf (or non-self-supporting) ladder. Preferably engaging at least two support regions 20, the configurable ladder system 100 can provide a stable standing area for the user 10 and permit the user 10 to stand close to the elevated work location 30 within the work environment. The configurable ladder system 100 thereby can enhance user safety.

Although shown and described with reference to FIG. 1A as being configured for use as a shelf ladder for purposes of illustration only, the configurable ladder system 100 can be configured into any of a plurality of different ladder configuration modes (or ladder types). Exemplary ladder configuration modes can include any conventional type of ladder, such as a platform ladder, an extension ladder, a shelf ladder, a step ladder, a step stool or a telescoping ladder, without limitation, with any predetermined number of side rails 110. The ladder configuration mode of the configurable ladder system 100 can be based upon one or more predetermined criteria, such as an intended use (or purpose) of the configurable ladder system 100 and/or an intended work environment. The configurable ladder system 100 can be changed from a first ladder configuration mode to a second ladder configuration mode, for example, if the configurable ladder system 100 is to be used for a different purpose and/or within a different work environment. In a preferred embodiment, the configurable ladder system 100 can support any predetermined number of different configuration modes. The configurable ladder system 100 advantageously can be readily adapted for use within a wide range of different purposes within a large number of a different work environments while enhancing user safety.

The configurable ladder system 100, for example, can be configured to transition between a shelf ladder mode and a step ladder mode. The configurable ladder system 100, in other words, can be configured for use as a shelf ladder as illustrated in FIG. 1A and/or as a step ladder as illustrated in FIG. 1B. In addition to including the side rails 110 as described above with reference to FIG. 1A, the configurable ladder system 100 advantageously can comprise one or more adjustable rails 130.

Each adjustable rail 130 can comprise an elongated structure with an upper end region 132 and a lower end region 134 that is opposite the upper end region 132. In selected embodiments, the adjustable rails 130 can include at least one pair of adjustable rails 130 that are separated by a predetermined distance. One or more optional cross-members (or cross pieces) 138 (shown in FIG. 16A) can be disposed between, and couple, the paired adjustable rails 130. The adjustable rails 130 and/or the cross-members 138 can be made of aluminum, steel, fiberglass, plastic, wood, a composite and/or any other material of suitable strength and durability, without limitation.

One or more support member 160 can be associated with a respective adjustable rail 130. In other words, a selected support member 160 can be associated with one or more adjustable rails 130. The selected support member 160 can span between, and couple with, a pair of adjustable rails 130 in selected embodiments. Alternatively and/or additionally, a selected adjustable rail 130 can be associated with one or more support members 160. The one or more support members 160, for example, can be disposed along a selected dimension of the selected adjustable rail 130.

The support members 160 can include a third support member 166 disposed at the lower end region 134 of the adjustable rail 130. The third support member 166 can be coupled with the adjustable rail 130 in any conventional manner and preferably are fixedly coupled with the adjustable rail 130. In some embodiments, the adjustable rail 130 can engage the third support member 166 via one or more fasteners (not shown), an adhesive, double-sided tape and/or a press (or interference) fit between the third support member 166 and the adjustable rail 130. As illustrated in FIGS. 1A-B, for example, the third support member 166 can be configured to engage the base support region 24 of the work environment.

Each side rail 110 can be coupled with one or more corresponding adjustable rails 130. Although one or more adjustable rails 130 can be fixedly coupled with a selected side rail 110, the side rail 110 and the corresponding adjustable rail 130 preferably are adjustably coupled. The side rail 110 and the corresponding adjustable rail 130, for example, can be rotatably or movably coupled via a hinge system 140. The hinge system 140 advantageously can enable the adjustable rail 130 to rotate relative to the side rail 110, enabling the configurable ladder system 100 to transition between the shelf ladder mode and the step ladder mode.

A respective hinge system 140 can be disposed between each side rail 110 and the corresponding adjustable rail 130. In selected embodiments, the hinge system 140 can couple the upper end region 112 of the relevant side rail 110 with the upper end region 132 of the corresponding adjustable rail 130. If a length of the relevant side rail 110 is greater than a length of the corresponding adjustable rail 130, for instance, the hinge system 140 can be disposed at an upper end of the corresponding adjustable rail 130 as illustrated in FIGS. 1A-B. The hinge system 140 thereby can be disposed at a predetermined distance from an upper end of the relevant side rail 110.

The hinge system 140 advantageously can enable the lower end region 134 of the corresponding adjustable rail 130 to be movable (or adjustable) relative to the lower end region 114 of the relevant side rail 110. The lower end region 134 of the corresponding adjustable rail 130, for example, can be disposed adjacent to the lower end region 114 of the relevant side rail 110 in the shelf ladder mode of the configurable ladder system 100 as shown in FIG. 1A. The side rails 110 and the adjustable rails 130 thereby can be in a generally parallel configuration in the shelf ladder mode. In the step ladder mode of FIG. 1B, the lower end region 134 of the corresponding adjustable rail 130 can be separated from the lower end region 114 of the relevant side rail 110. The corresponding adjustable rail 130, for example, can rotate about the hinge system 140 relative to the relevant side rail 110 to form an inverted V-shape.

The ladder system 100 can include one or more optional spreader brace systems 150 as illustrated in FIG. 1B. Each spreader brace system 150 can extend between a relevant side rail 110 and the corresponding adjustable rail 130. The spreader brace system 150 can maintain the separation between the lower end region 114 of the relevant side rail 110 and the lower end region 134 of the corresponding adjustable rail 130 when the ladder system 100 is the step ladder mode. By maintaining the separation between the lower end regions 114, 134, the spreader brace system 150 advantageously can help enhance the stability and safety of the ladder system 100 during use. In selected embodiments, the spreader brace system 150 can retract when the ladder system 100 transitions from the step ladder mode to the shelf ladder mode. The spreader brace system 150 thereby can enable the lower end region 134 of the corresponding adjustable rail 130 to be disposed adjacent to the lower end region 114 of the relevant side rail 110.

As shown in FIG. 1B, for example, the spreader brace system 150 can comprise a first brace member 152 for coupling with the relevant side rail 110 and a second brace member 156 for coupling with the corresponding adjustable rail 130. The first brace member 152 can be provided as an elongated member with a first end region associated with the relevant side rail 110. The first brace member 152 and the relevant side rail 110 can be rotatably (or movably) coupled via a first pivoting (or hinge) system 154.

Additionally and/or alternatively, the second brace member 156 can be provided as an elongated member with a first end region associated with the corresponding adjustable rail 130. The second brace member 156 and the corresponding adjustable rail 130 can be rotatably (or movably) coupled via a second pivoting (or hinge) system 158. A third pivoting (or hinge) system 155 can rotatably (or movably) couple the first and second brace members 152, 156. The third pivoting system 155, for example, can couple second end regions of the first and second brace members 152, 156. In selected embodiments, the second end region of the first brace member 152 can be opposite the first end region of the first brace member 152, and/or the second end region of the second brace member 156 can be opposite the first end region of the second brace member 156.

As illustrated in FIG. 1B, the first and second brace members 152, 156 can form an obtuse angle via the third pivoting system 155 when the ladder system 100 is the step ladder mode. The obtuse angle can comprise any predetermined angle greater than a right angle and, as shown, can extend to comprise a one hundred and eighty degree angle such that the first and second brace members 152, 156 are longitudinally aligned. The first and second brace members 152, 156 preferably lock to maintain the separation between the lower end region 114 of the relevant side rail 110 and the lower end region 134 of the corresponding adjustable rail 130. In other words, the first and second brace members 152, 156 can be biased to maintain the obtuse angle as long as the ladder system 100 remains in the step ladder mode. When locked, the predetermined angle formed between the first and second brace members 152, 156 can exceed one hundred and eighty degrees.

As the ladder system 100 transitions from the step ladder mode to the shelf ladder mode, the angle formed between the first and second brace members 152, 156 via the third pivoting system 155 can decrease from the extended obtuse angle. The angle formed between the first and second brace members 152, 156, for example, can be between zero degrees and ten degrees when the ladder system 100 is in the shelf ladder mode. The first and second brace members 152, 156 can at least partially overlap and, in some embodiments, can be at least partially disposed within an envelope or volume defined by the side rails 110 and/or adjustable rails 130. The lower end region 134 of the corresponding adjustable rail 130 thereby can be disposed adjacent to the lower end region 114 of the relevant side rail 110 in the shelf ladder mode of the ladder system 100 as shown in FIG. 1A.

Figure 2:
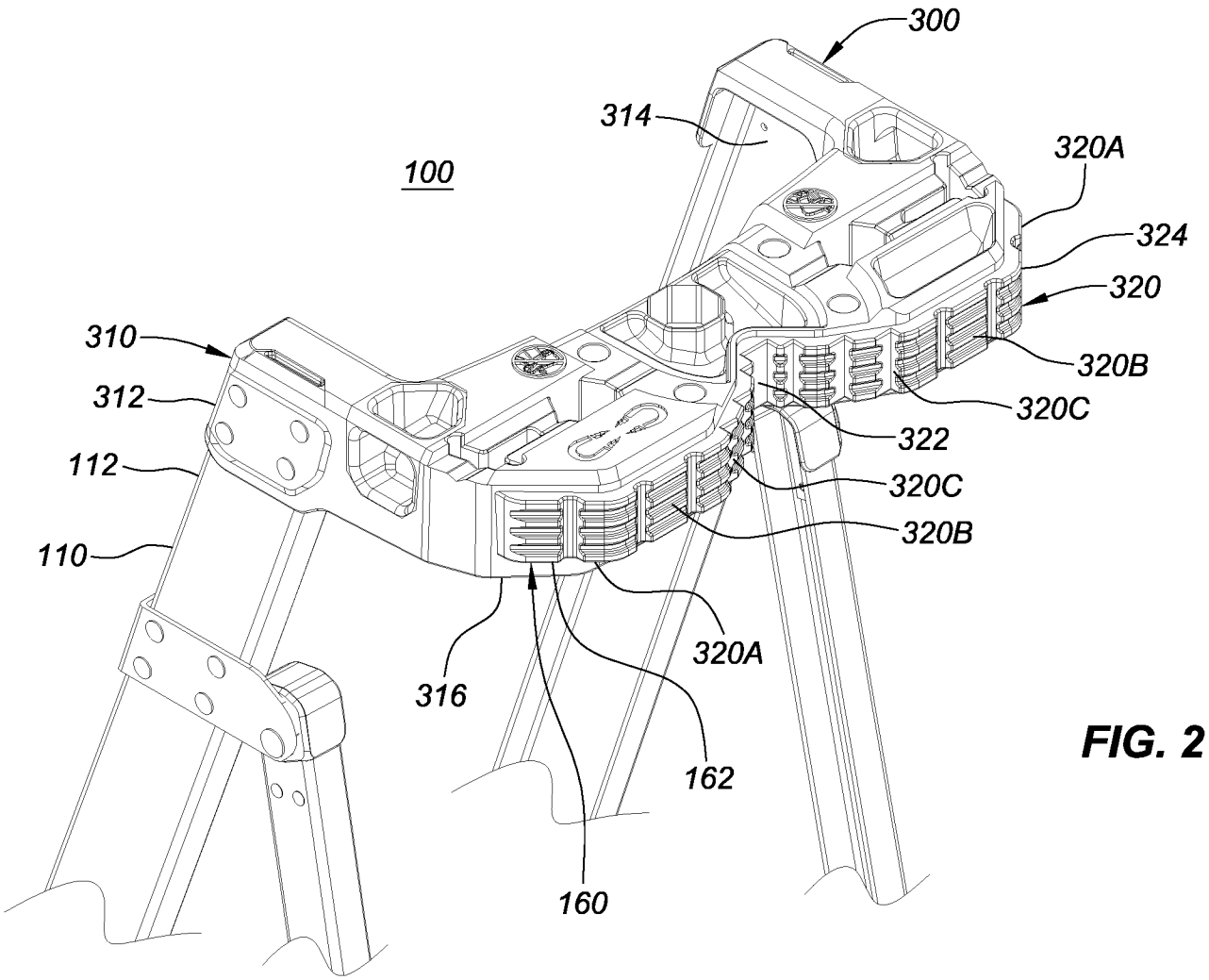
FIG. 2 is an exemplary detail drawing illustrating an alternative embodiment of the convertible ladder system of FIGS. 1A-B, wherein the convertible ladder system includes a ladder cap apparatus with a support member.

Turning to FIG. 2, the configurable ladder system 100 is shown as including an optional ladder cap apparatus 300. The ladder cap apparatus 300 can be disposed at the upper end region 112 of at least one of the side rails 110. In selected embodiments, the ladder cap apparatus 300 can comprise a central cap body 310 with a first body region 312 for coupling with the relevant upper end region 112. The central cap body 310 of FIG. 2, for example, is shown as defining a mounting channel 314 for receiving the upper end region 112 of a selected side rail 110. The cap body 310 preferably defines a pair of mounting channels 314 for receiving the upper end regions 112 of a pair of side rails 110. The side rails 110 thereby can fixedly engage the ladder cap apparatus 300 via, for example, one or more fasteners (not shown), an adhesive, double-sided tape and/or a press (or interference) fit between the cap body 310 and the side rails 110.

The ladder cap apparatus 300 advantageously can provide at least one of the support members 160 discussed above with reference to FIGS. 1A-B. As shown in FIG. 2, the ladder cap apparatus 300 can provide the first support member 162 can be formed on or otherwise coupled with the central cap body 310 and configured to engage the selected support region 20, such as the elevated support regions 22, (collectively shown in FIG. 1A) within the work environment of the configurable ladder system 100. The first support member 162 can be associated with a second body region 316 of the central cap body 310. The second body region 316 preferably is distal from the first body region 312 of the central cap body 310. The first support member 162, in other words, can extend from the side rails 110 such that the first support member 162 can be disposed between the side rails 110 and the elevated support region 22 during use as illustrated in FIG. 1A.

The first support member 162 advantageously can be provided with any predetermined shape, size and/or dimension for engaging a wide variety of selected support regions 20 with different and/or similar geometries. As shown in FIG. 2, for example, the first support member 162 can be provided as a multifaceted support member 320 with a plurality of engagement regions 320A-C. The engagement regions 320A-C can comprise separate engagement regions and/or can include at least one partially integrated engagement region. Stated somewhat differently, the engagement regions 320A-C can include one or more pieces of non-skid surface material.

Figure 3A:
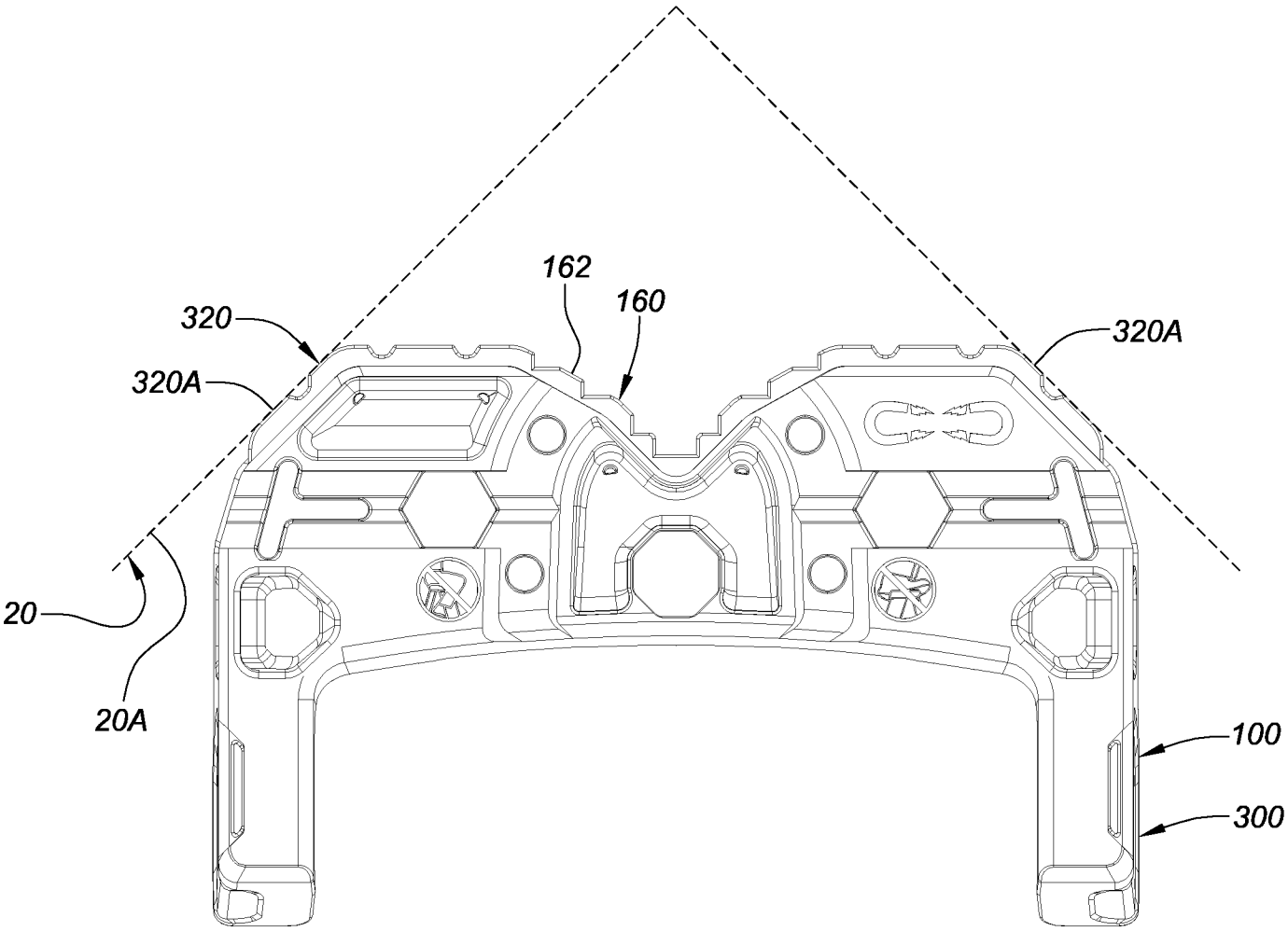
FIG. 3A is an exemplary detail drawing illustrating an alternative embodiment of the ladder cap apparatus of FIG. 2, wherein the support member is configured to engage an inside corner.
Figure 3B:
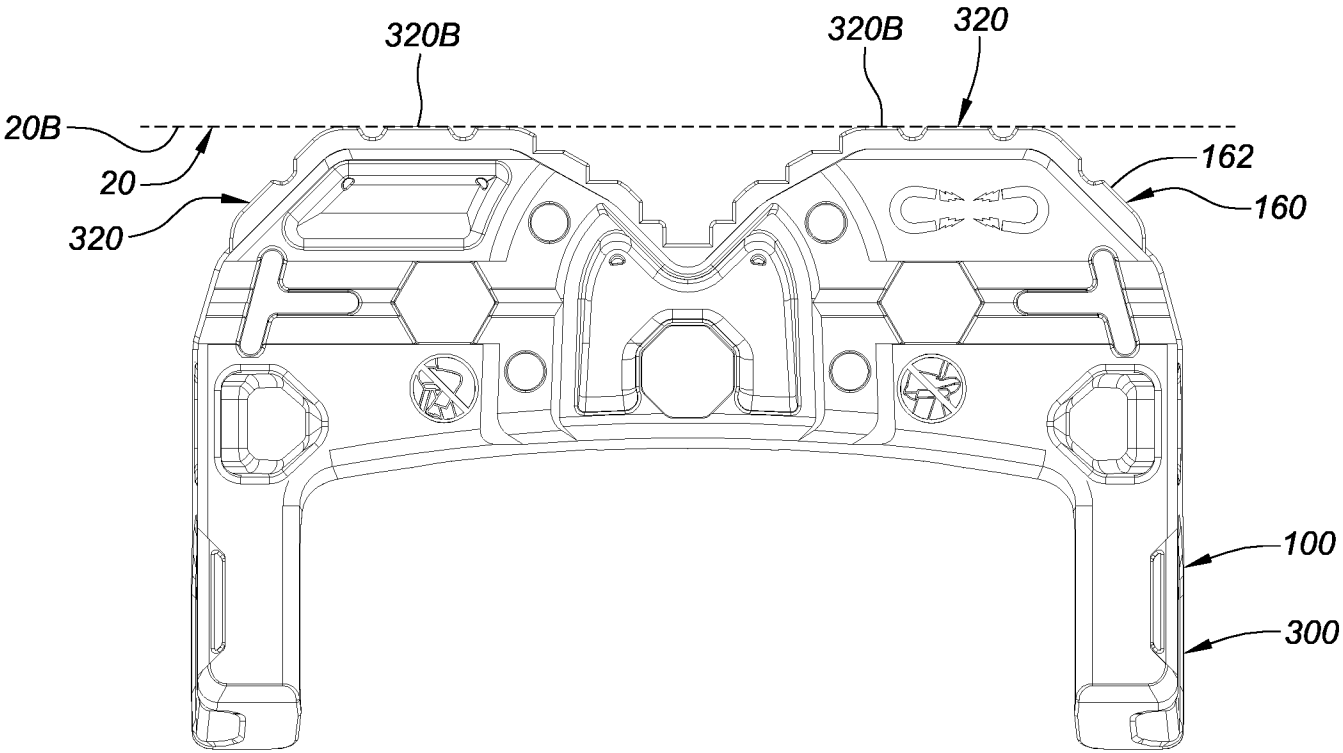
FIG. 3B is an exemplary detail drawing illustrating another alternative embodiment of the ladder cap apparatus of FIG. 2, wherein the support member is configured to engage a flat surface.

In some embodiments, one or more of the engagement regions 320A-C can provide a single interface for engaging the selected support region 20. Additionally and/or alternatively, at least one of the engagement regions 320A-C can be provided as a plurality of interfaces for engaging the selected support region 20. By providing the plurality of interfaces, the support member 320 advantageously can enhance user safety by engaging the selected support region 20 via more than one point of contact. As shown in FIG. 3A, for example, the support member 320 can include a pair of inwardly angled engagement regions 320B for engaging an inside (or concave) corner 20A that provides the selected support region 20. If the selected support region 20 includes a flat (or planar) surface (or periphery) 20B, the support member 320 can include a pair of planar engagement regions 320B for engaging the flat surface 20B as shown in FIG. 3B.

Figure 3C:
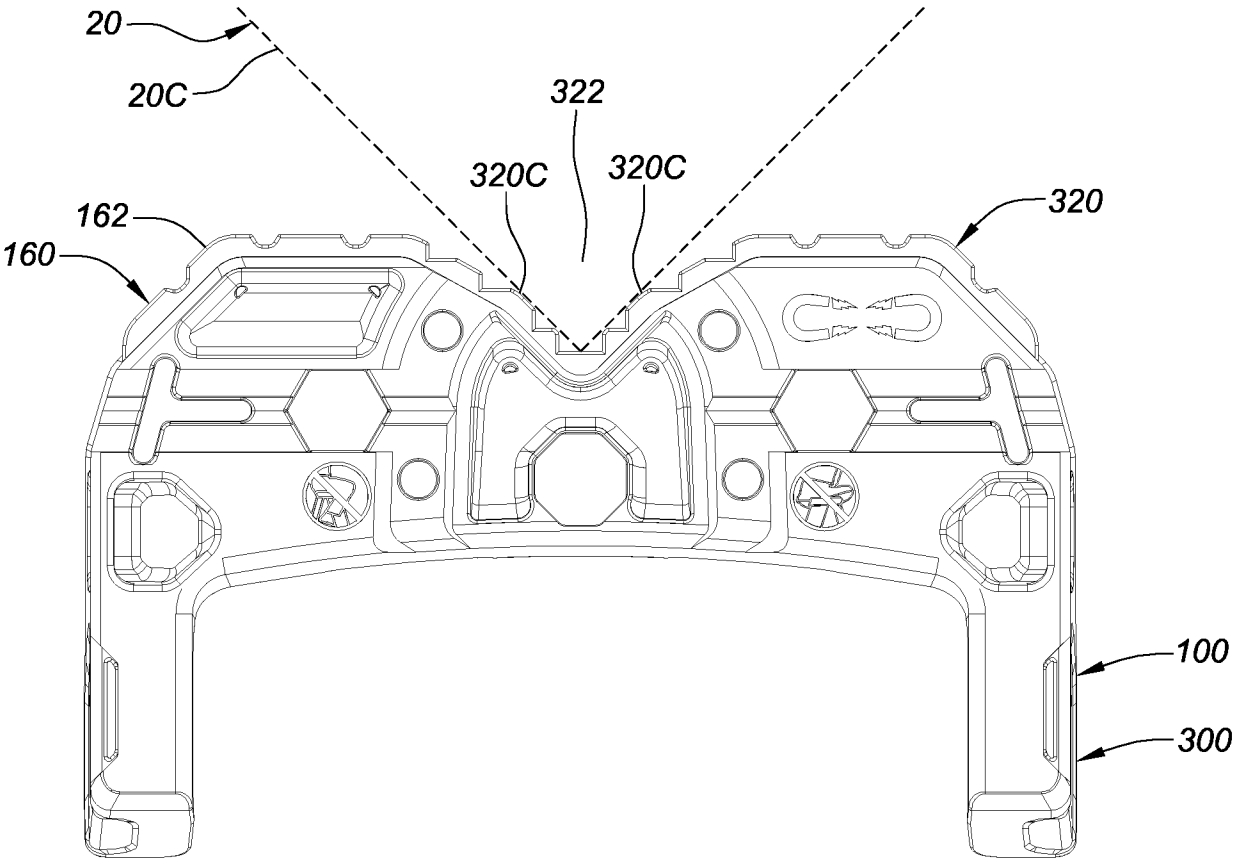
FIG. 3C is an exemplary detail drawing illustrating still another alternative embodiment of the ladder cap apparatus of FIG. 2, wherein the support member is configured to engage an outside corner.

Turning to FIG. 3C, the support member 320 can include an optional pair of outwardly angled engagement regions 320C. The outwardly angled engagement regions 320C are shown as engaging an outside (or convex) corner 20C. Additionally and/or alternatively, the outwardly angled engagement regions 320C can engage other types of selected support regions 20, such as a concave round surface (or periphery), a convex round surface (or periphery) 20D (shown in FIG. 5), a pole and/or a board 20E-H (shown in FIGS. 6-9). The outwardly angled engagement regions 320C advantageously can define a channel 322 for receiving the selected support region 20. The selected support region 20 thereby can be received (or captured) within the channel 322, enhancing the engagement between the outwardly angled engagement regions 320C and the selected support region 20. At least one of the engagement regions 320A-C can include one or more projection members 324 (shown in FIG. 2) for further enhancing the engagement between the configurable ladder system 100 and the selected support region 20. Although shown and described with reference to FIG. 2 as providing three engagement regions 320A-C for purposes of illustration only, the support member 320 can include any suitable number, type and/or arrangement of engagement regions for engaging one or more selected support regions 20.

Figure 4A:
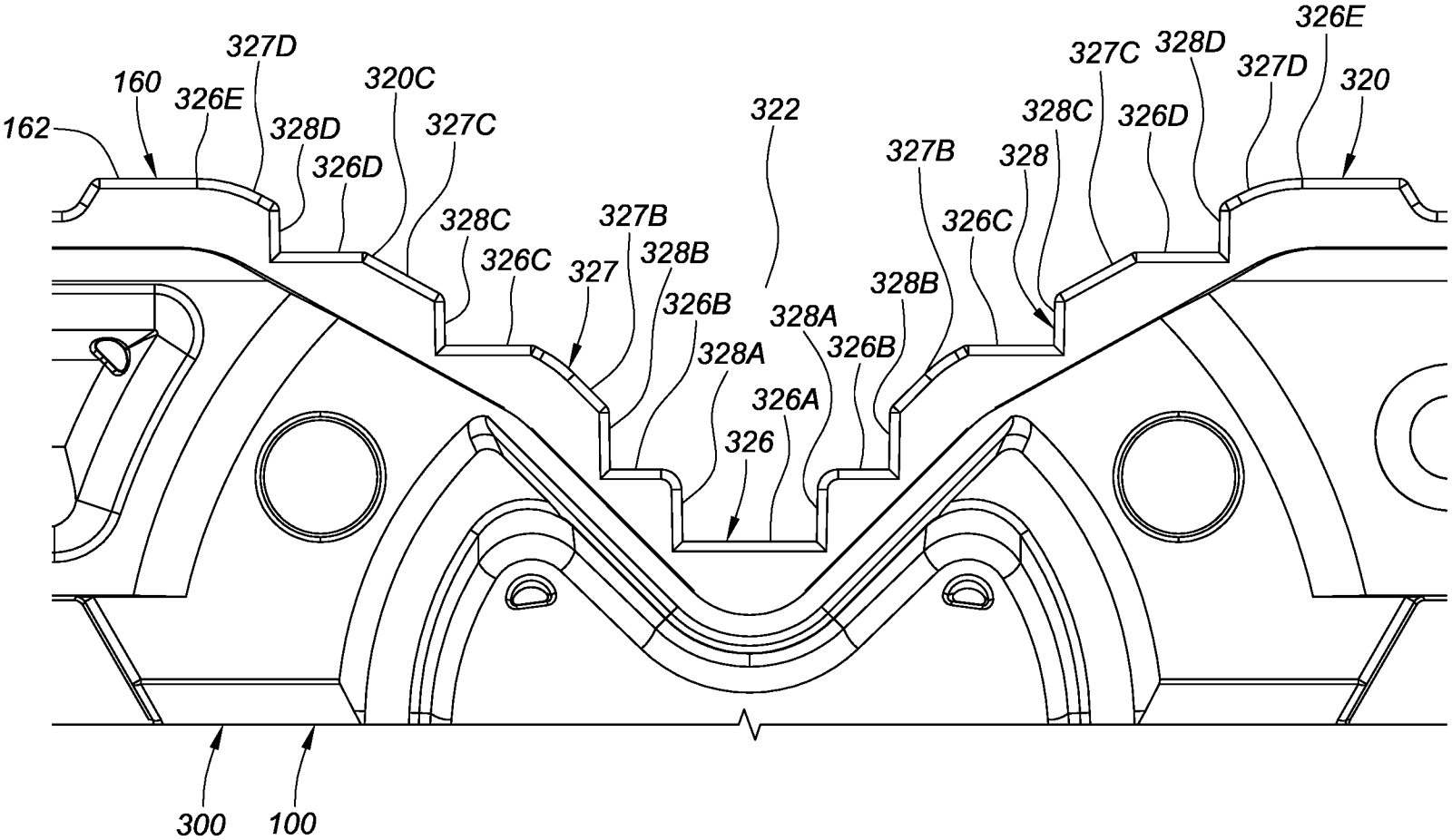
FIGS. 4A-B are exemplary detail drawings illustrating an alternative embodiment of the ladder cap apparatus of FIG. 3C, wherein the support member is provided as a succession of support member levels.
Figure 4B:
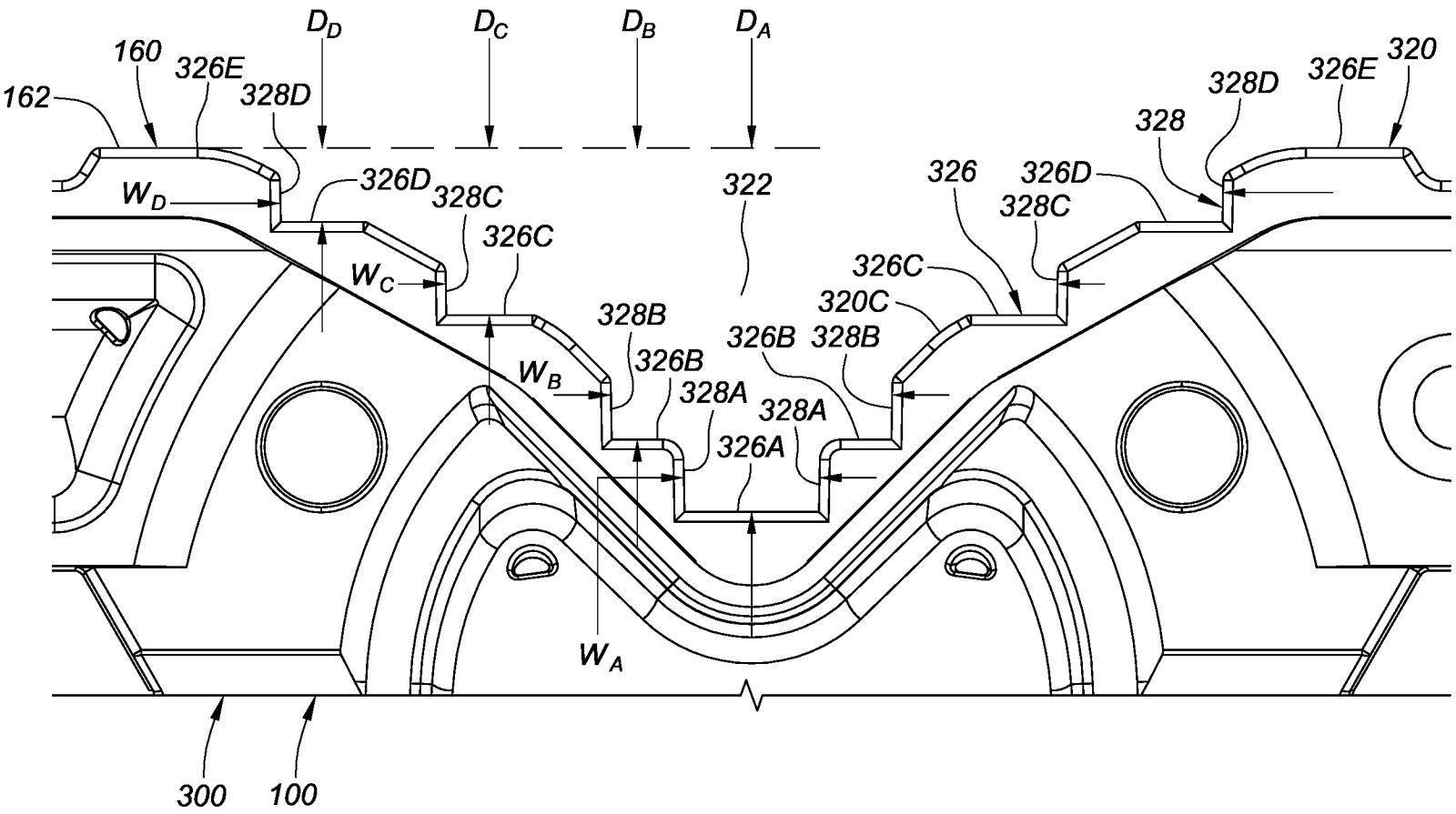

The outwardly angled engagement regions 320C of the ladder cap apparatus 300 can define the channel 322 with any predetermined size, shape and/or dimension suitable for receiving the various different types of selected support regions 20. Although the channel 322 can be defined with a V-shape with a smooth profile, the outwardly angled engagement regions 320C preferably define the channel 322 with a stepped profile with a plurality of engagement surfaces (or peripheries) 326 as illustrated in FIGS. 4A-B. In other words, each engagement surface 326 can be bounded by opposite side surfaces 328 such that the stepped profile comprises an alternating sequence of the engagement surface 326 and the side surfaces 328. The channel 322 thereby can be at least partially defined by the engagement surface 326 and the side surfaces 328.

Transitions (or intersections) between the engagement surfaces 326 and the side surfaces 328 can be formed with any predetermined angle, such as a right angle. In some embodiments, one of more of the intersections can comprise a straight and/or curved chamfered (or angled) portion 327 for enhancing and otherwise facilitating the engagement between the support member 320 of the configurable ladder system 100 and the selected support region 20 (shown in FIG. 3C). The chamfered portion 327, for example, can present a larger cross-section of surface area than a right-angled intersection for engaging the selected support region 20. In other words, support regions 20 with a rounded or angled support profiles can be engaged by one or more of the intersections between the engagement surfaces 326 and the side surfaces 328 such that the chamfered portions 327 can enhance the engagement between such support regions 20 and the support member 320.

Turning to FIG. 4A, the support member 320 is shown as including a central engagement surface 326A. The central engagement surface 326A can be disposed at a base (or, alternatively, an apex) of the channel 322. As shown in FIG. 4A, side surfaces 328A can be disposed on opposite sides of the central engagement surface 326A. In other words, the central engagement surface 326A can be disposed between the side surfaces 328A. The side surfaces 328A can displace the central engagement surfaces 326A from respective engagement surfaces 326B such that, upon being received within the channel 322, the selected support region 20 (shown in FIG. 3C) encounters at least one of the engagement surfaces 326B before encountering the central engagement surface 326A.

In the manner set forth above, a transition (or intersection) between the side surfaces 328A and the respective engagement surfaces 326B can be formed with any predetermined angle. The predetermined angles can include a predetermined acute angle, a right angle and/or a predetermined obtuse angle. A first predetermined angle formed between a first side surface 328A and the relevant engagement surface 326B can be the same as, or different from, a second predetermined angle formed between a second side surface 328A and the relevant engagement surface 326B. As shown in FIG. 4A, the first and second predetermined angles each comprise right angles.

The stepped profile can include optional side surfaces 328B and/or optional engagement surfaces 326C. Each engagement surface 326B can be disposed between a relevant side surface 328A and a relevant side surface 328B as illustrated in FIG. 4A, and each engagement surface 326C can be displaced from the relevant engagement surface 326B by a respective side surface 328B. The side surfaces 328B can displace the engagement surfaces 326B from the respective engagement surfaces 326C such that, upon being received within the channel 322, the selected support region 20 encounters at least one of the engagement surfaces 326C before encountering the engagement surfaces 326B.

A transition between the side surfaces 328B and the respective engagement surfaces 326C can be formed with any predetermined angle, including a predetermined acute angle, a right angle and/or a predetermined obtuse angle. The transition between the side surfaces 328B and the respective engagement surfaces 326C is shown in FIG. 4A as comprising a chamfer portion 327B. The chamfer portion 327B can be provided in the manner set forth above and can enhance the engagement between the support member 320 and the selected support region 20. A first chamfer portion 327B disposed between a first side surface 328B and the relevant engagement surface 326C can be the same as, or different from, a second chamfer portion 327B formed between a second side surface 328B and the relevant engagement surface 326C.

The stepped profile can include optional side surfaces 328C and/or optional engagement surfaces 326D. Each engagement surface 326C can be disposed between a relevant side surface 328B and a relevant side surface 328C as illustrated in FIG. 4A, and each engagement surface 326D can be displaced from the relevant engagement surface 326C by a respective side surface 328C. The side surfaces 328C can displace the engagement surfaces 326C from the respective engagement surfaces 326D such that, upon being received within the channel 322, the selected support region 20 encounters at least one of the engagement surfaces 326D before encountering the engagement surfaces 326C.

A transition between the side surfaces 328C and the respective engagement surfaces 326D can be formed with any predetermined angle, including a predetermined acute angle, a right angle and/or a predetermined obtuse angle. The transition between the side surfaces 328C and the respective engagement surfaces 326D is shown in FIG. 4A as comprising a chamfer portion 327C. The chamfer portion 327C can be provided in the manner set forth above and can enhance the engagement between the support member 320 and the selected support region 20. A first chamfer portion 327C disposed between a first side surface 328C and the relevant engagement surface 326D can be the same as, or different from, a second chamfer portion 327C formed between a second side surface 328C and the relevant engagement surface 326D.

The stepped profile can include optional side surfaces 328D and/or optional engagement surfaces 326E. Each engagement surface 326D can be disposed between a relevant side surface 328C and a relevant side surface 328D as illustrated in FIG. 4A, and each engagement surface 326E can be displaced from the relevant engagement surface 326D by a respective side surface 328D. The side surfaces 328D can displace the engagement surfaces 326D from the respective engagement surfaces 326E such that, upon being received within the channel 322, the selected support region 20 encounters at least one of the engagement surfaces 326E before encountering the engagement surfaces 326D.

A transition between the side surfaces 328D and the respective engagement surfaces 326E can be formed with any predetermined angle, including a predetermined acute angle, a right angle and/or a predetermined obtuse angle. The transition between the side surfaces 328D and the respective engagement surfaces 326E is shown in FIG. 4A as comprising a chamfer portion 327D. The chamfer portion 327D can be provided in the manner set forth above and can enhance the engagement between the support member 320 and the selected support region 20. A first chamfer portion 327D disposed between a first side surface 328D and the relevant engagement surface 326E can be the same as, or different from, a second chamfer portion 327D formed between a second side surface 328D and the relevant engagement surface 326E. Although the stepped profile preferably is symmetric about the central engagement surface 326A, the stepped profile can be asymmetric and can include one or more asymmetric engagement surfaces 326, chamfered portions 327, side surfaces 328 and/or other stepped profile features.

Turning to FIG. 4B, the stepped profile of the channel 322 is shown as being defined with a progressively decreasing cross-section from the engagement surfaces 326E to the central engagement surface 326A. The decreasing cross-section of the channel 322, in other words, can be defined by the engagement surfaces 326, chamfered portions 327, side surfaces 328 and/or other stepped profile features. The engagement surfaces 326D, for example, can be displaced by a predetermined depth $D_D$ from the respective engagement surfaces 326E and, in the manner set forth above with reference to FIG. 4A, can be bounded by the side surfaces 328D. The side surfaces 328D can be separated by a predetermined width of $W_D$. Accordingly, the engagement surfaces 326D and the side surfaces 328D can define a portion of the cross-section of the channel 322. In selected embodiments, the portion of the cross-section of the channel 322 defined by the engagement surfaces 326D and the side surfaces 328D can comprise an initial portion of the cross-section of the channel 322 as the selected support region 20 (shown in FIG. 3C) is received within the channel 322.

The cross-section of the channel 322 can be further defined by the engagement surfaces 326C and the side surfaces 328C. As illustrated in FIG. 4B, the engagement surfaces 326C can be displaced by a predetermined depth Dc from the respective engagement surfaces 326E. The engagement surfaces 326C can be bounded by the side surfaces 328C, which can be separated by a predetermined width of $W_C$. The engagement surfaces 326C and the side surfaces 328C can define a portion of the cross-section of the channel 322 that is adjacent to the portion of the cross-section of the channel 322 defined by the engagement surfaces 326D and the side surfaces 328D.

The cross-section of the channel 322 can be further defined by the engagement surfaces 326B and the side surfaces 328B. As illustrated in FIG. 4B, the engagement surfaces 326B can be displaced by a predetermined depth $D_B$ from the respective engagement surfaces 326E. The engagement surfaces 326B can be bounded by the side surfaces 328B, which can be separated by a predetermined width of $W_B$. The engagement surfaces 326B and the side surfaces 328B can define a portion of the cross-section of the channel 322 that is adjacent to the portion of the cross-section of the channel 322 defined by the engagement surfaces 326C and the side surfaces 328C.

The cross-section of the channel 322 can be further defined by the central engagement surface 326A and the side surfaces 328A. As illustrated in FIG. 4B, the central engagement surface 326A can be displaced by a predetermined depth $D_A$ from the respective engagement surfaces 326E. The central engagement surface 326A can be bounded by the side surfaces 328A, which can be separated by a predetermined width of $W_A$. The central engagement surface 326A and the side surfaces 328A can define a portion of the cross-section of the channel 322 that is adjacent to the portion of the cross-section of the channel 322 defined by the engagement surfaces 326B and the side surfaces 328B.

Although shown and described with reference to FIGS. 4A-B as having five engagement surfaces 326A-E, four side surfaces 328A-D and three chamfer portion 327B-D for purposes of illustration only, the channel 322 can be defined by any predetermined number of engagement surfaces 326, chamfered portions 327, side surfaces 328 and/or other stepped profile features. Additionally and/or alternatively, the predetermined depths $D_A$-$D_D$ can comprise one or more uniform and/or different depths. The predetermined depth $D_D$, for example, can be within a first range between one-eight inch and one inch, the predetermined depth $D_C$ can be within a second range between one-quarter inch and two inches, the predetermined depth $D_B$ can be within a third range between three-eighths inch and three inches and/or the predetermined depth $D_A$ can be within a fourth range between one-half inch and four inches.

The predetermined widths $W_A$-$W_D$ can include any suitable widths, including one or more widths associated with predetermined features of at least one standardized support region 20. In a preferred embodiment, the predetermined width $W_A$ can comprise a width of one inch, the predetermined width $W_B$ can comprise a width of two inches the predetermined width $W_C$ can comprise a width of four inches and/or the predetermined width $W_D$ can comprise a width of six inches. The support member 320 thereby can engage a width and/or a depth of a wide range of support regions 20 with respective sizes, shapes and/or dimensions. Exemplary support regions 20 can include one or more poles and other round support members 20D (shown in FIG. 5) and/or on or more rectangular (or square) support members, such as at least one standardized board. Typical standardized boards can include, but are not limited to, a one inch by four inch (1"×4") standardized board 20E (shown in FIGS. 6A-B), a two inch by four inch (2"×4") standardized board 20F (shown in FIGS. 7A-B), a one inch by six inch (1"×6") standardized board 20G (shown in FIGS. 8A-B), and/or a two inch by six inch (2"×6") standardized board 20H (shown in FIGS. 9A-B).

Figure 5:
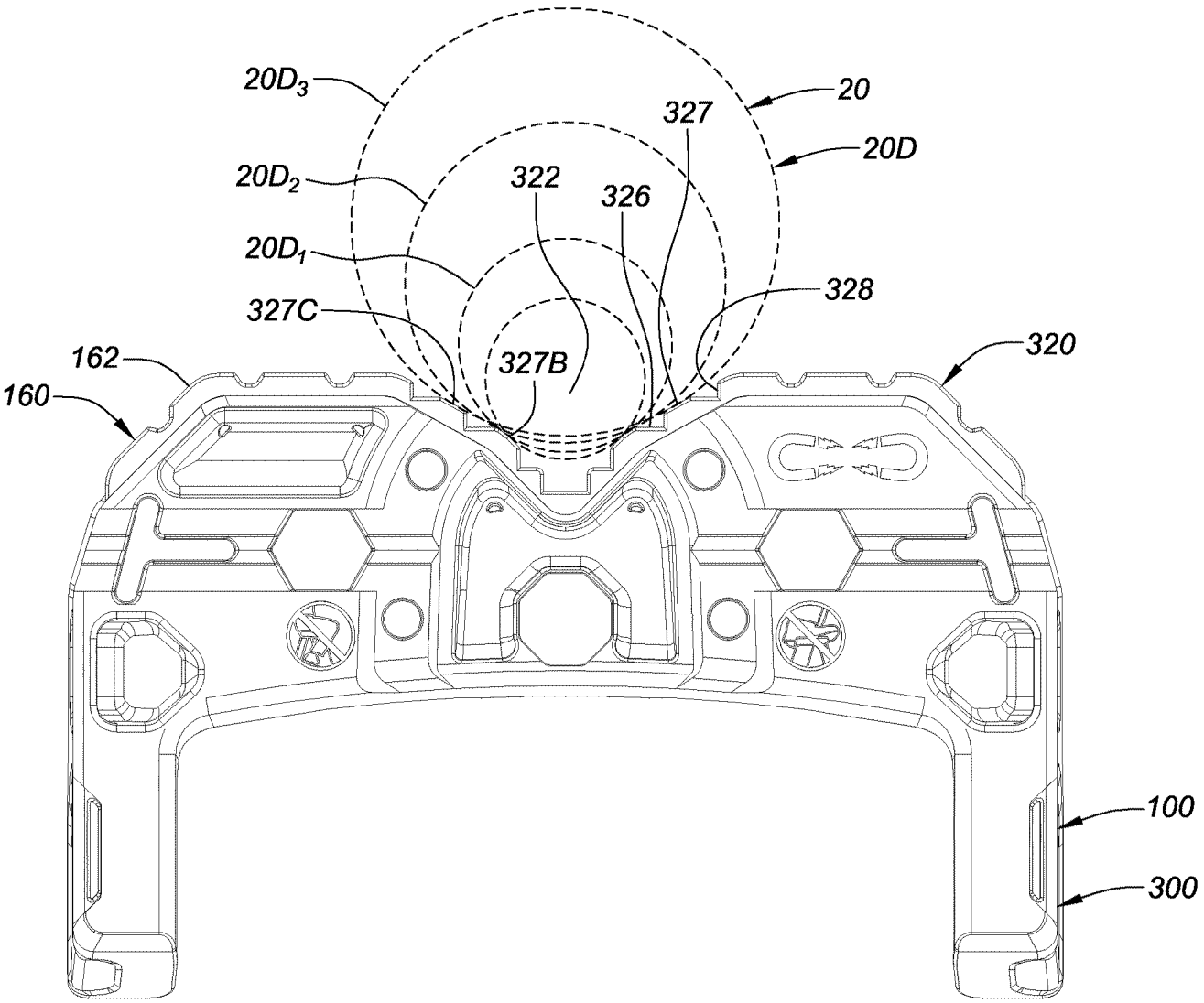
FIG. 5 is an exemplary detail drawing illustrating an alternative embodiment of the ladder cap apparatus of FIGS. 4A-B, wherein the support member is configured to engage a round support member.

Turning to FIG. 5, for example, the configurable ladder system 100 is shown as including the support member 320 that is configured to engage a pole or other type of round support member 20D. The round support member 20D, in other words, can present a predetermined feature with a convex round surface for being received within the channel 322 defined by the outwardly angled engagement regions 320C and being engaged by one or more of the engagement surfaces 326, one or more of the chamfered portions 327, one or more of the side surfaces 328 and/or one or more other stepped profile features. The engagement surfaces 326, chamfered portions 327, side surfaces 328 and/or other stepped profile features that engage the round support member 20D, for example, can depend at least in part upon a diameter of the round support member 20D.

The round support member 20D, for example, can comprise a first round support member 20$D_1$ with a first predetermined diameter, a second round support member 20$D_2$ with a second predetermined diameter or a third round support member 20$D_3$ with a third predetermined diameter.

As illustrated in FIG. 5, the second predetermined diameter of the second round support member 20$D_2$ can be greater than the first predetermined diameter of the first round support member 20$D_1$ and less than the third predetermined diameter of the third round support member 20$D_3$. The first round support member 20$D_1$ can be received within the channel 322 and engage a selected engagement surface 326, chamfered portion 327, side surface 328 and/or other stepped profile feature. Due at least in part to the first diameter, the first round support member 20$D_1$ can engage the chamfered portion 327B as shown in FIG. 5. The first round support member 20$D_1$ optionally can at least partially engage the engagement surface 326C and/or the side surface 328B that are adjacent to the chamfered portion 327B (collectively shown in FIGS. 4A-B).

Alternatively, the second round support member 20$D_2$ likewise can be received within the channel 322 and engage a selected engagement surface 326, chamfered portion 327, side surface 328 and/or other stepped profile feature. Due at least in part to the second diameter, the second round support member 20$D_2$ can engage the chamfered portion 327B and/or the chamfered portion 327C as illustrated in FIG. 5. The second round support member 20$D_2$ optionally can at least partially engage the engagement surface 326C and/or the side surface 328B that are adjacent to the chamfered portion 327B and/or the engagement surface 326D and/or the side surface 328C that are adjacent to the chamfered portion 327C (collectively shown in FIGS. 4A-B).

The third round support member 20$D_3$ alternatively can be received within the channel 322 and engage a selected engagement surface 326, chamfered portion 327, side surface 328 and/or other stepped profile feature. Due at least in part to the third diameter, the third round support member 20$D_3$ can engage the chamfered portion 327C as shown in FIG. 5.

The third round support member 20$D_3$ optionally can at least partially engage the engagement surface 326D and/or the side surface 328C that are adjacent to the chamfered portion 327C.

Additionally and/or alternatively, the support member 320 of the configurable ladder system 100 can be configured to engage one or more different sizes of support region 20 with a rectangular and/or square surface, such as a standardized board. A selected standardized board, stated somewhat differently, can present a predetermined feature with a rectangular (or square) surface for being received within the channel 322 defined by the outwardly angled engagement regions 320C and being engaged by one or more of the engagement surfaces 326, one or more of the chamfered portions 327, one or more of the side surfaces 328 and/or one or more other stepped profile features. The engagement surfaces 326, chamfered portions 327, side surfaces 328 and/or other stepped profile features that engage the selected standardized board, for example, can depend at least in part upon one or more dimensions of the selected standardized board.

Figure 6A:
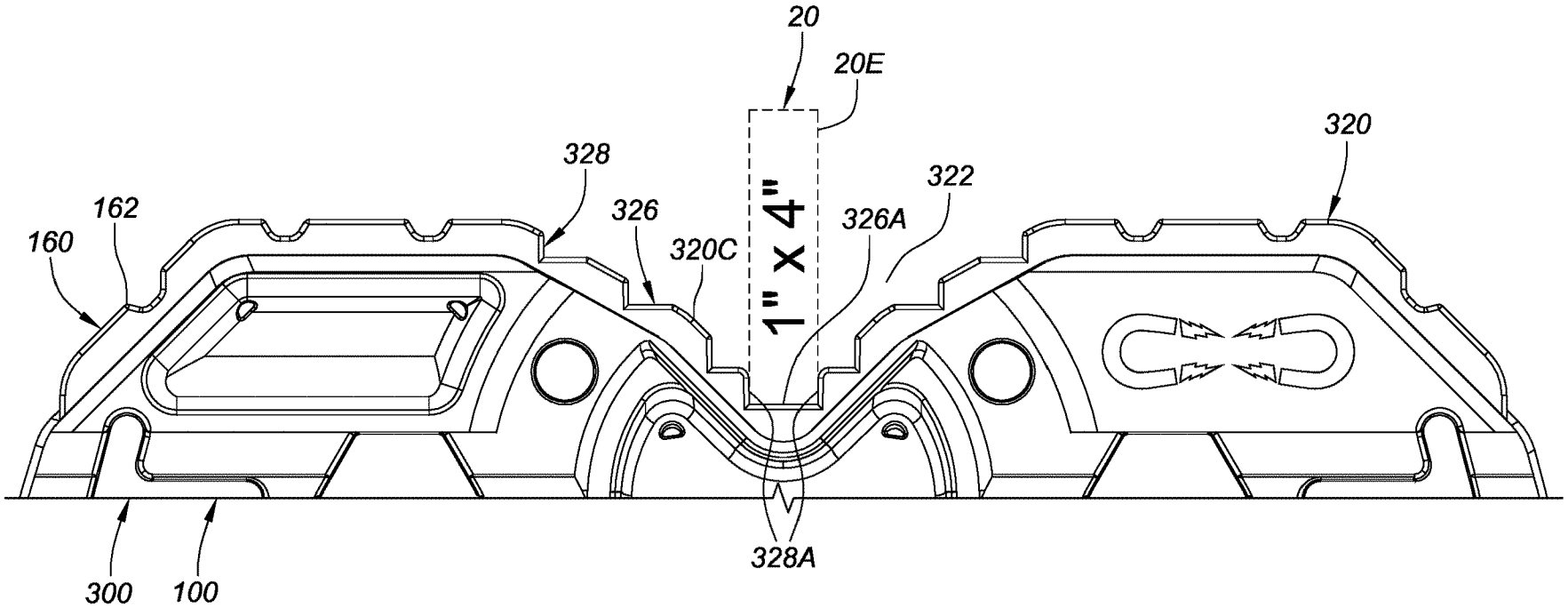
FIGS. 6A-B are exemplary detail drawings illustrating another alternative embodiment of the ladder cap apparatus of FIGS. 4A-B, wherein the support member is configured to engage a standardized 1"33 4" board.
Figure 6B:
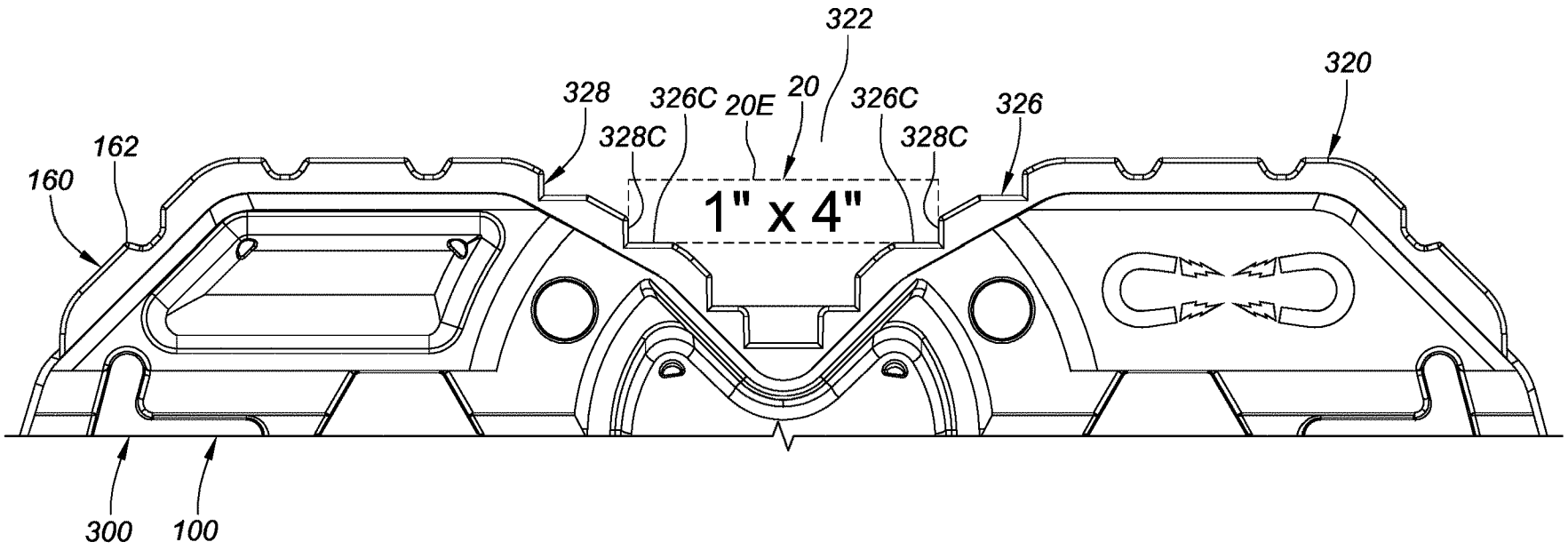

Turning to FIGS. 6A-B, for example, the configurable ladder system 100 is shown as including the support member 320 that is configured to engage a one inch by four inch (1"×4") standardized board 20E. The standardized board 20E can be received within the channel 322 of the support member 320 and engaged by one or more suitable engagement surfaces 326 and/or side surfaces 328. As shown in FIG. 6A, for example, the standardized board 20E can be received within the channel 322 in depthwise orientation. If the predetermined width $W_A$ (shown in FIG. 4B) is equal to one inch, the standardized board 20E can be received into the channel 322 until disposed between, and engaged by, the central engagement surface 326A and/or the side surfaces 328A.

The standardized board 20E alternatively can be received within the channel 322 of the support member 320 in widthwise orientation as shown in FIG. 6B. In the widthwise orientation, the standardized board 20E can be disposed between, and engaged by, the engagement surface 326C and/or the side surfaces 328C when the predetermined width $W_C$ (shown in FIG. 4B) is equal to four inches. Although described as comprising exemplary widths of one inch and four inches, respectively, to simplify the discussion, the predetermined widths $W_A$, $W_C$ preferably are greater than the exemplary widths to facilitate insertion and/or removal of the standardized board 20E within the channel 322.

Figure 7A:
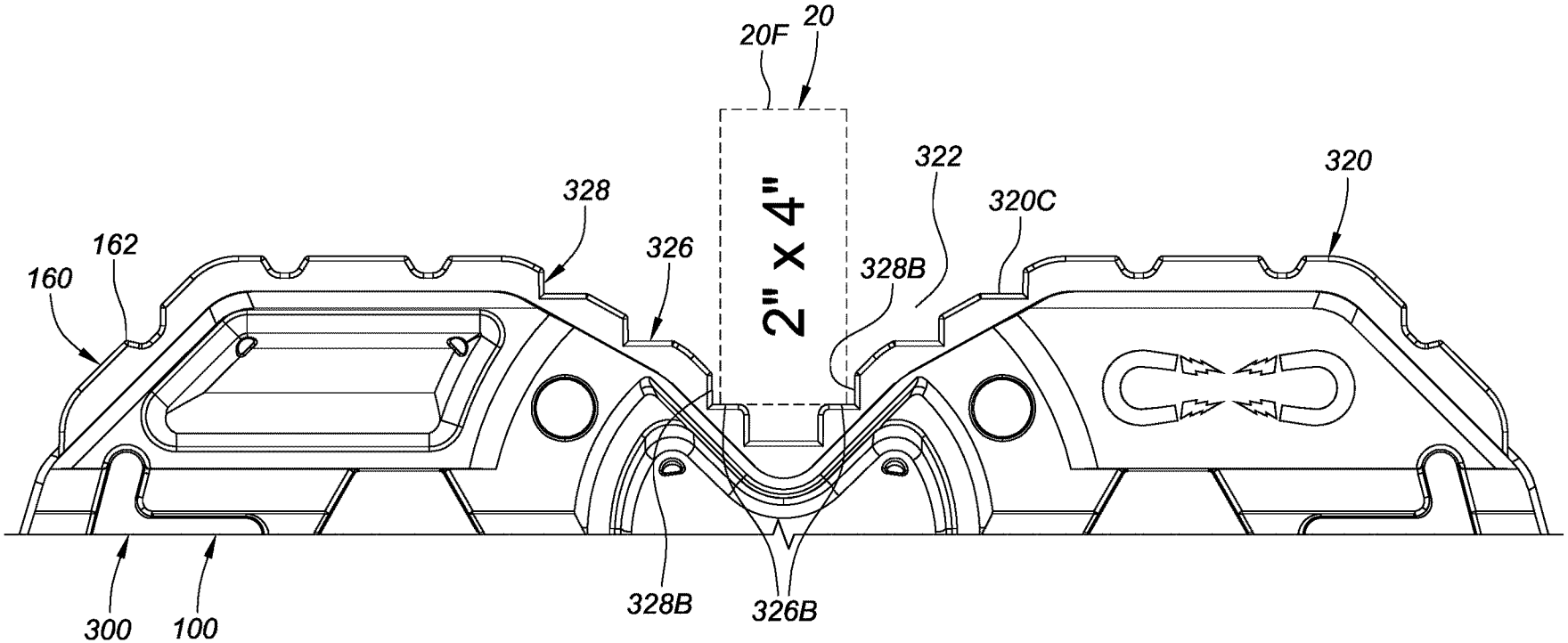
FIGS. 7A-B are exemplary detail drawings illustrating an alternative embodiment of the ladder cap apparatus of FIGS. 6A-B, wherein the support member is configured to engage a standardized 2"×4" board.
Figure 7B:
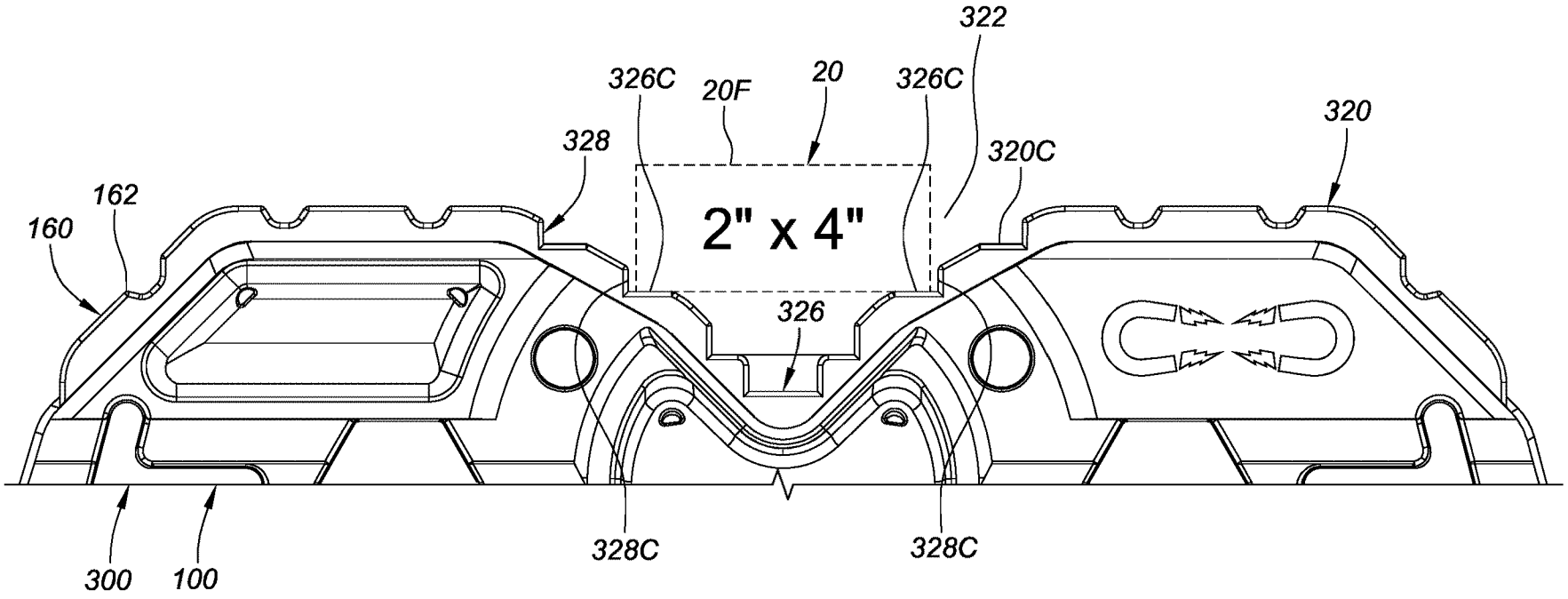

FIGS. 7A-B show an alternative embodiment of the configurable ladder system 100, wherein the support member 320 is configured to engage a two inch by four inch (2"×4") standardized board 20F. The standardized board 20F can be received within the channel 322 of the support member 320 and engaged by one or more suitable engagement surfaces 326 and/or side surfaces 328. As shown in FIG. 7A, for example, the standardized board 20F can be received within the channel 322 in depthwise orientation. If the predetermined width $W_B$ (shown in FIG. 4B) is equal to two inches, the standardized board 20F can be received into the channel 322 until disposed between, and engaged by, the engagement surfaces 326B and/or the side surfaces 328B.

Alternatively, the standardized board 20F can be received within the channel 322 of the support member 320 in widthwise orientation as shown in FIG. 7B. In the widthwise orientation, the standardized board 20F can be disposed between, and engaged by, the engagement surfaces 326C and/or the side surfaces 328C when the predetermined width $W_C$ (shown in FIG. 4B) is equal to four inches. Although described as comprising exemplary widths of two inches and four inches, respectively, to simplify the discussion, the predetermined widths $W_B$, $W_C$ preferably are greater than the exemplary widths to facilitate insertion and/or removal of the standardized board 20F within the channel 322.

Figure 8A:
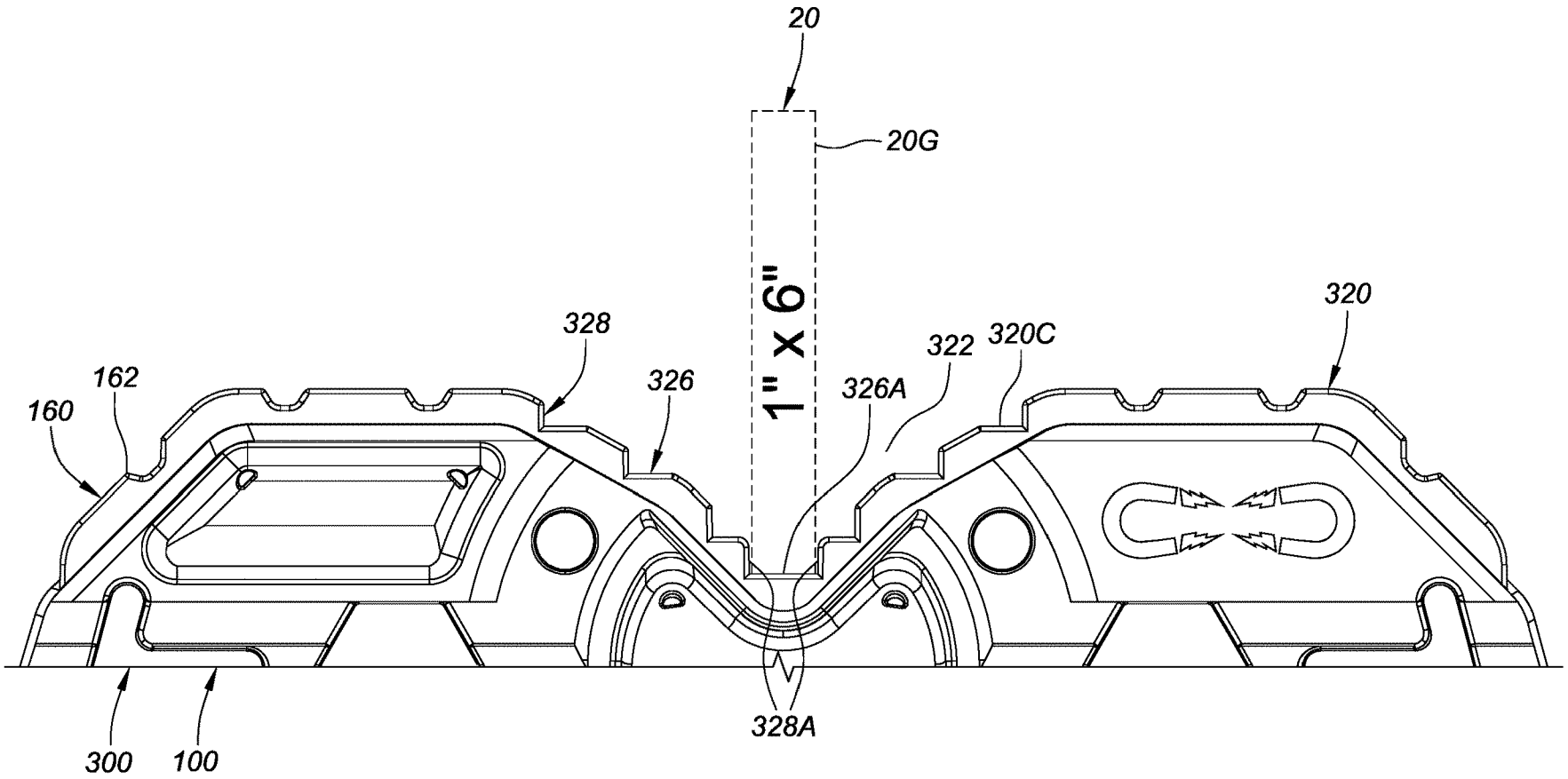
FIGS. 8A-B are exemplary detail drawings illustrating another alternative embodiment of the ladder cap apparatus of FIGS. 6A-B, wherein the support member is configured to engage a standardized 1"×6" board.
Figure 8B:
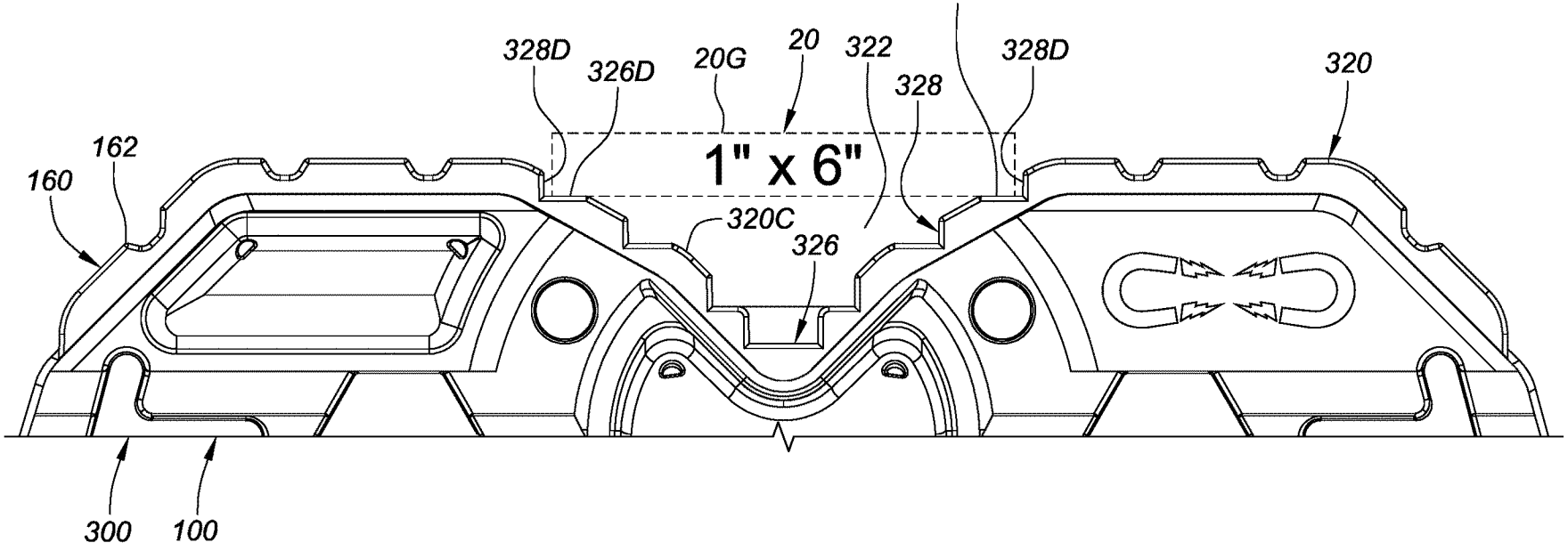

Turning to FIGS. 8A-B, the configurable ladder system 100 is shown as including the support member 320 that is configured to engage a one inch by six inch (1"×6") standardized board 20G. The standardized board 20G can be received within the channel 322 of the support member 320 and engaged by one or more suitable engagement surfaces 326 and/or side surfaces 328. As shown in FIG. 8A, for example, the standardized board 20G can be received within the channel 322 in depthwise orientation. If the predetermined width $W_A$ (shown in FIG. 4B) is equal to one inch, the standardized board 20G can be received into the channel 322 until disposed between, and engaged by, the central engagement surface 326A and/or the side surfaces 328A.

The standardized board 20G alternatively can be received within the channel 322 of the support member 320 in widthwise orientation as shown in FIG. 8B. In the widthwise orientation, the standardized board 20G can be disposed between, and engaged by, the engagement surface 326D and/or the side surfaces 328D when the predetermined width $W_D$ (shown in FIG. 4B) is equal to six inches. Although described as comprising exemplary widths of one inch and six inches, respectively, to simplify the discussion, the predetermined widths $W_A$, $W_D$ preferably are greater than the exemplary widths to facilitate insertion and/or removal of the standardized board 20G within the channel 322.

Figure 9A:
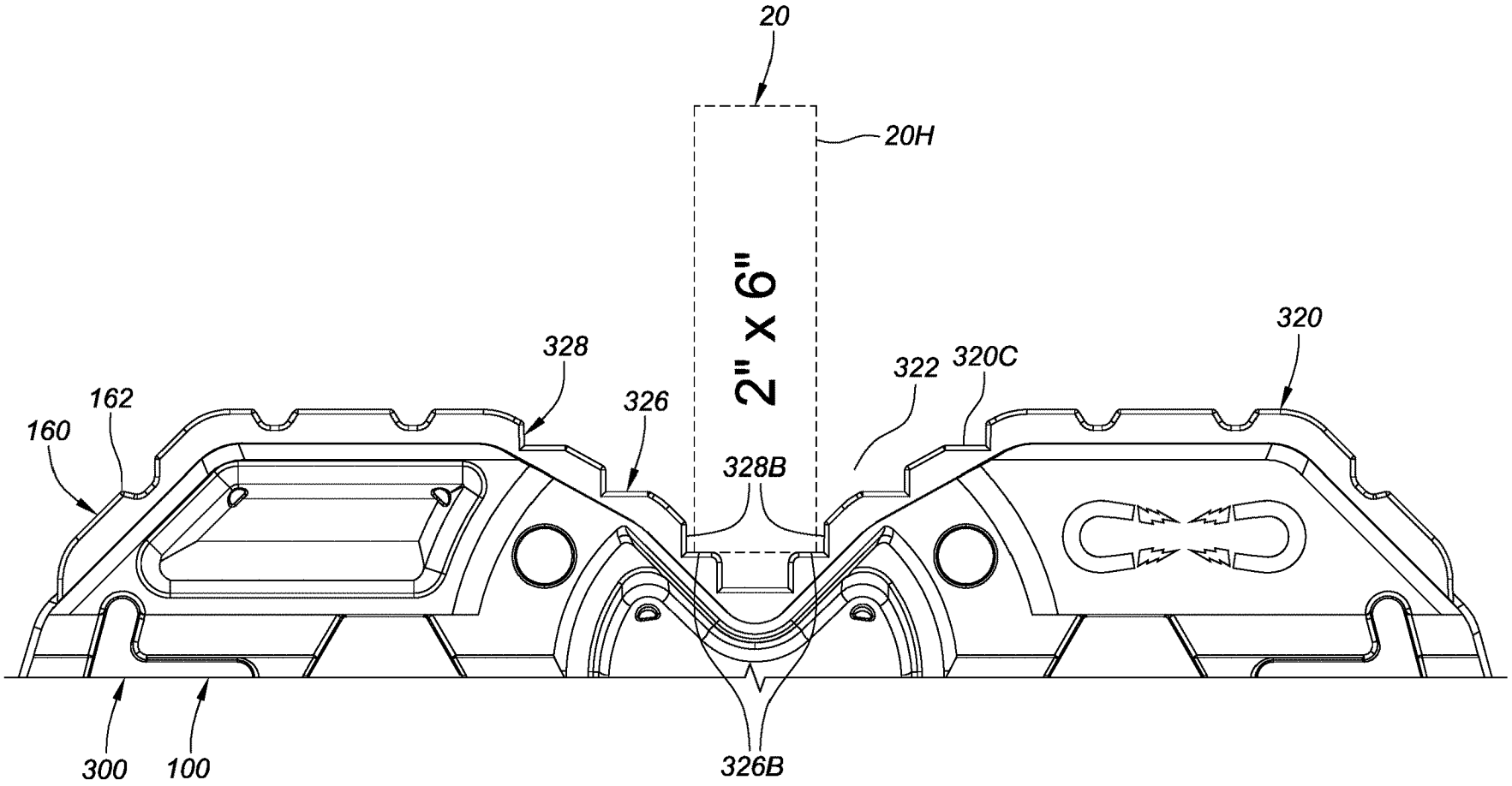
FIGS. 9A-B are exemplary detail drawings illustrating still another alternative embodiment of the ladder cap apparatus of FIGS. 6A-B, wherein the support member is configured to engage a standardized 2"×6" board.
Figure 9B:
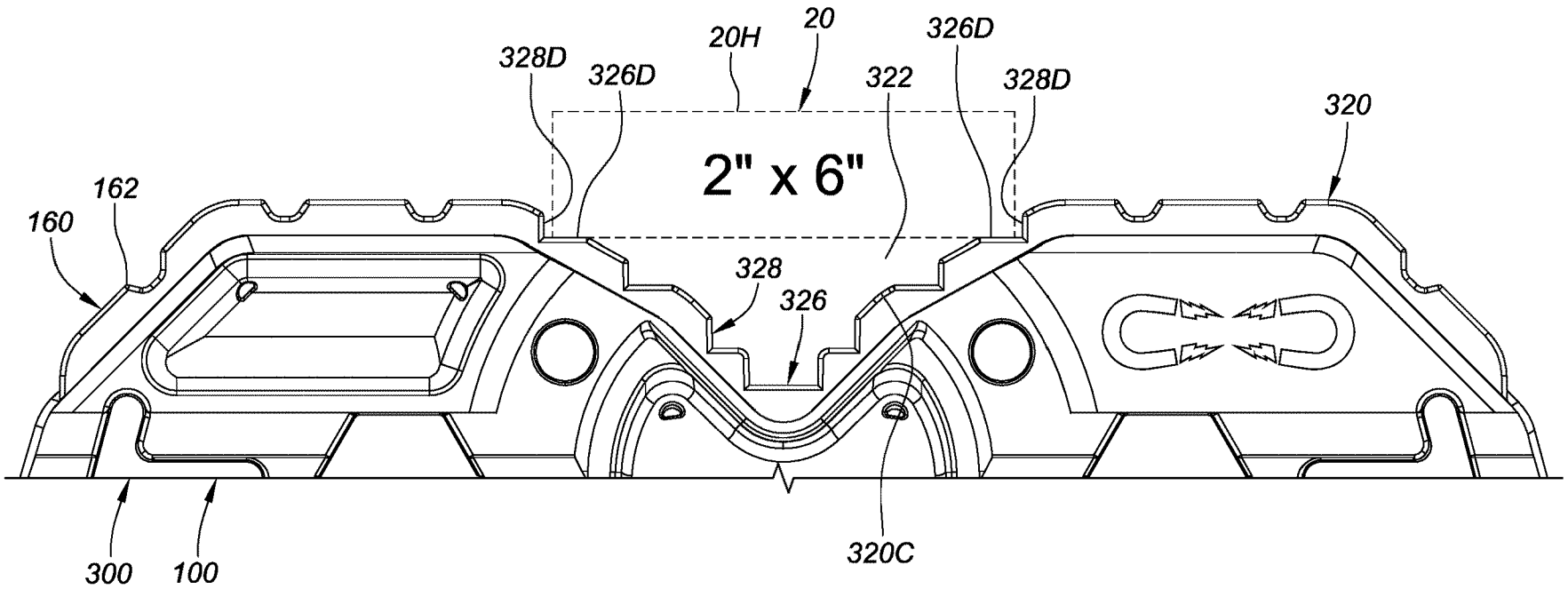

The configurable ladder system 100 of FIGS. 9A-B, can include the support member 320 that is configured to engage a two inch by six inch (2"×6") standardized board 20H. The standardized board 20H can be received within the channel 322 of the support member 320 and engaged by one or more suitable engagement surfaces 326 and/or side surfaces 328. As shown in FIG. 9A, for example, the standardized board 20H can be received within the channel 322 in depthwise orientation. If the predetermined width $W_B$ (shown in FIG. 4B) is equal to two inches, the standardized board 20H can be received into the channel 322 until disposed between, and engaged by, the engagement surfaces 326B and/or the side surfaces 328B.

Alternatively, the standardized board 20H can be received within the channel 322 of the support member 320 in widthwise orientation as shown in FIG. 9B. In the widthwise orientation, the standardized board 20H can be disposed between, and engaged by, the engagement surfaces 326D and/or the side surfaces 328D when the predetermined width $W_D$ (shown in FIG. 4B) is equal to six inches. Although described as comprising exemplary widths of two inches and six inches, respectively, to simplify the discussion, the predetermined widths $W_B$, $W_D$ preferably are greater than the exemplary widths to facilitate insertion and/or removal of the standardized board 20H within the channel 322.

Figure 10A:
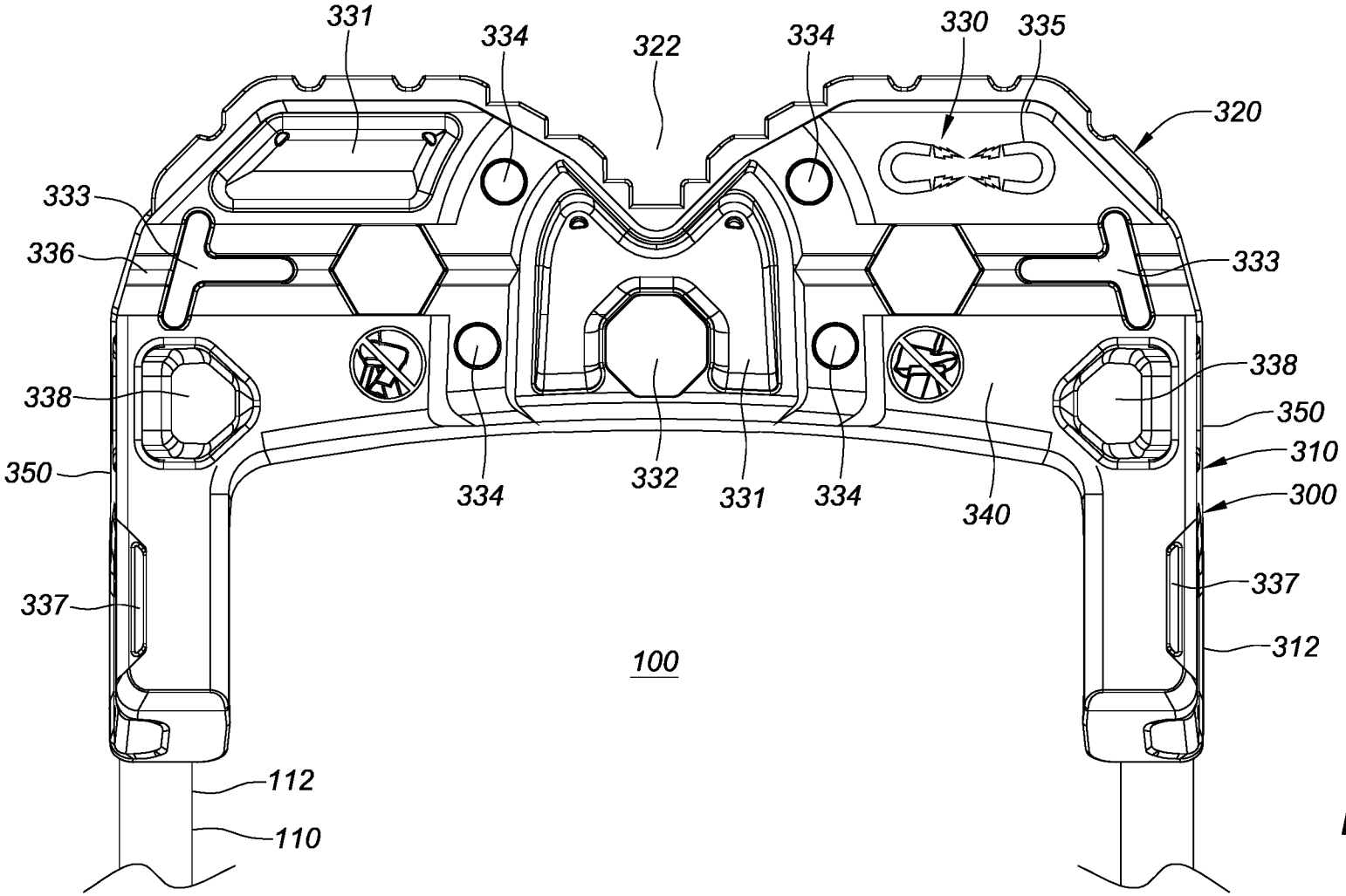
FIGS. 10A-B are exemplary detail drawings illustrating still another alternative embodiment of the ladder cap apparatus of FIG. 2, wherein the ladder cap apparatus comprising a ladder working cap apparatus.
Figure 10B:
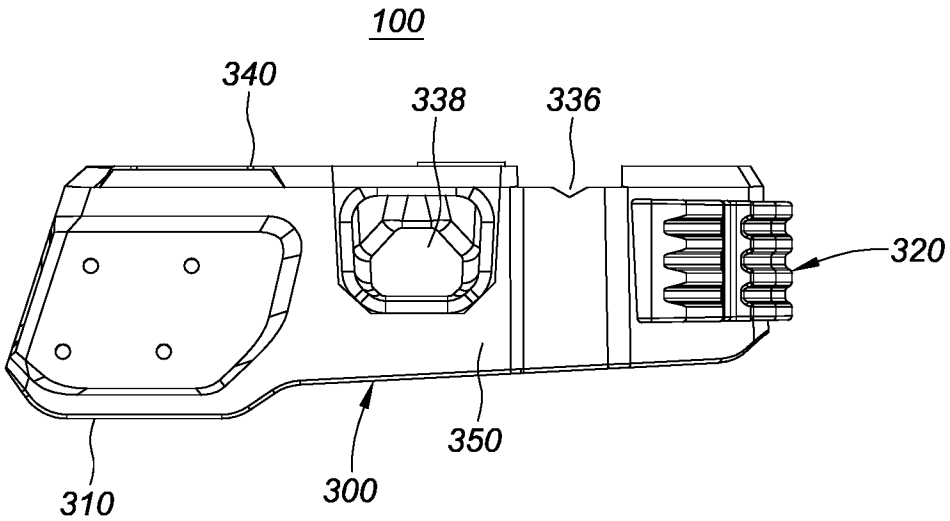

In selected embodiments, the ladder cap apparatus 300 advantageously can comprise ladder working cap apparatus 330 as illustrated in FIGS. 10A-B. The ladder working cap apparatus 330 can be configured to provide storage and otherwise support for any tools, workpieces, safety gear and other equipment that the user 10 (shown in FIGS. 1A-B) might want and/or need while using the configurable ladder system 100. In other words, the central cap body 310 can provide one or more selected working cap elements 331-338. Although shown and described with reference to FIGS. 10A-B as providing a predetermined arrangement of the selected working cap elements 331-338 for purposes of illustration only, the ladder working cap apparatus 330 can provide any suitable arrangement of any predetermined number and/or variety of working cap elements.

The selected working cap elements 331-338 can be accessed via a top region 340 and/or one or more side regions 350 of the central cap body 310. Exemplary selected working cap elements 331-338 can include at least one hardware tray 331 for retaining an assortment of one or more nails, screws and/or other hardware items. Additionally and/or optionally, the ladder working cap apparatus 330 can include one or more tools holders for regaining tools.

Exemplary tool holders can include a drill holder 332, a pliers (and/or spatter) holder 333, a screwdriver holder 334 and/or a tape measure holder 337. Each hardware tray 331, drill holder 332, pliers holder 333, screwdriver holder 334 and/or tape measure holder 337 can comprise respective recessed region or other opening formed in the central cap body 310 and accessible via the top region 340.

The ladder working cap apparatus 330 can include an optional magnet element 335 for attracting nails, screws and other ferromagnetic objects. A workpiece support 336 can support a board, a pipe or other workpiece (not shown). As shown in FIGS. 10A-B, the workpiece support 336 can comprise channel formed in the top region 340 and/or side regions 350 of the central cap body 310. The channel can be configured to receive and support the workpiece while the user 10 cuts or otherwise attends to the workpiece and/or while the user 10 attends to other tasks unrelated to the workpiece.

Figure 11:
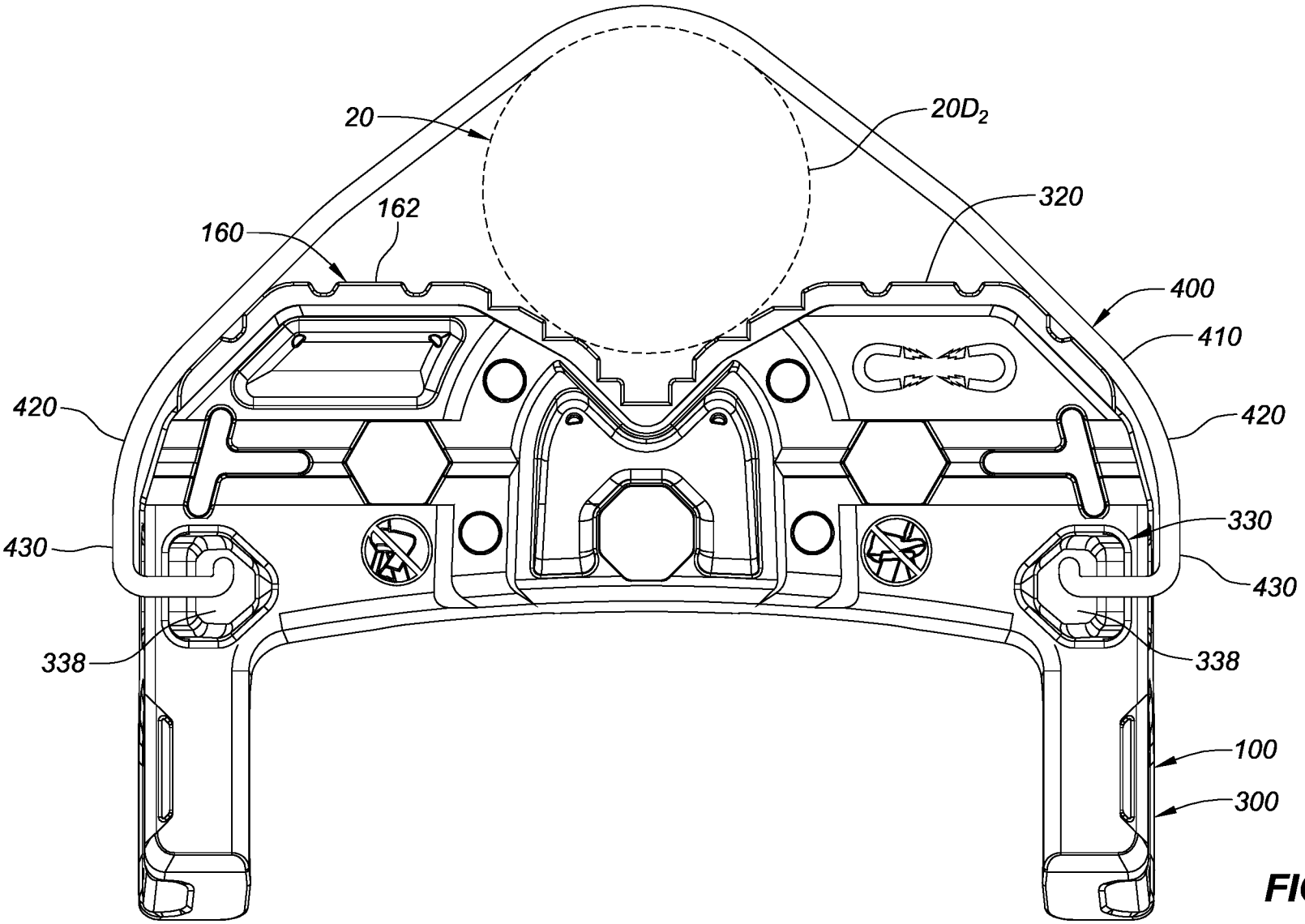
FIG. 11 is an exemplary detail drawing illustrating a perspective view of an alternative embodiment of the ladder working cap apparatus of FIGS. 10A-B, wherein the ladder working cap apparatus can be secured to a selected support structure via a safety strap system.

Advantageously, the ladder working cap apparatus 330 can include one or more carabiner (or strap) holders 338. Each carabiner holder 338 can comprise a channel formed within the central cap body 310 and communicating with a first opening defined by the top region 340 and a second opening defined in a selected side region 350. As shown in FIG. 11, for example, the carabiner holders 338 can further enhance the engagement between the configurable ladder system 100 and the selected support region 20. The carabiner holders 338 can provide a physical coupling between the configurable ladder system 100 and a selected support region 20. The physical coupling can be provided, for example, via a strap, cable, rope, latch or other type of physical connection. Additionally and/or alternatively, the carabiner holders 338 can be configured to connect one or more tools with the ladder working cap apparatus 330.

Turning to FIG. 11, for example, the ladder working cap apparatus 330 of the configurable ladder system 100 can be secured to the selected support region 20 via a safety strap system 400. The safety strap system 400 can include a strap 410 with connectors 430, such as carabiners and/or hooks, coupled with opposite end regions 420 of the strap 410. The carabiner holders 338 can be configured to couple with the connectors 430. In selected embodiments, each connector 430 can extend into the relevant channel formed in the top region 340 and/or side regions 350 of the central cap body 310. The connector 430, when extended into the relevant channel, preferably can form an enclosed loop for capturing and retaining at least a portion of the central cap body 310. In other words, the connector 430 can transition from an open configuration for being received with in the channel to a closed configuration for retaining at least a portion of the central cap body 310.

In use, the strap 410 can be wrapped around a periphery of the selected support region 20 as illustrated in FIG. 11. A first connector 430 of the safety strap system 400 can be coupled with a first carabiner holder 338. The coupling can include the first connector 430 in the open configuration and being received within a channel associated with the first carabiner holder 338. The first connector 430 can transition into the closed configuration for capturing and retaining at least a portion of the central cap body 310 associated the first carabiner holder 338.

The second connector 430 of the safety strap system 400 similarly can be coupled with a second carabiner holder 338. The coupling can include the second connector 430 in the open configuration and being received within a channel associated with the second carabiner holder 338. The second connector 430 can transition into the closed configuration for capturing and retaining at least a portion of the central cap body 310 associated the second carabiner holder 338. A length of the strap 410 can be adjusted to provide a secure engagement with the periphery of the selected support region 20.

Figure 12:
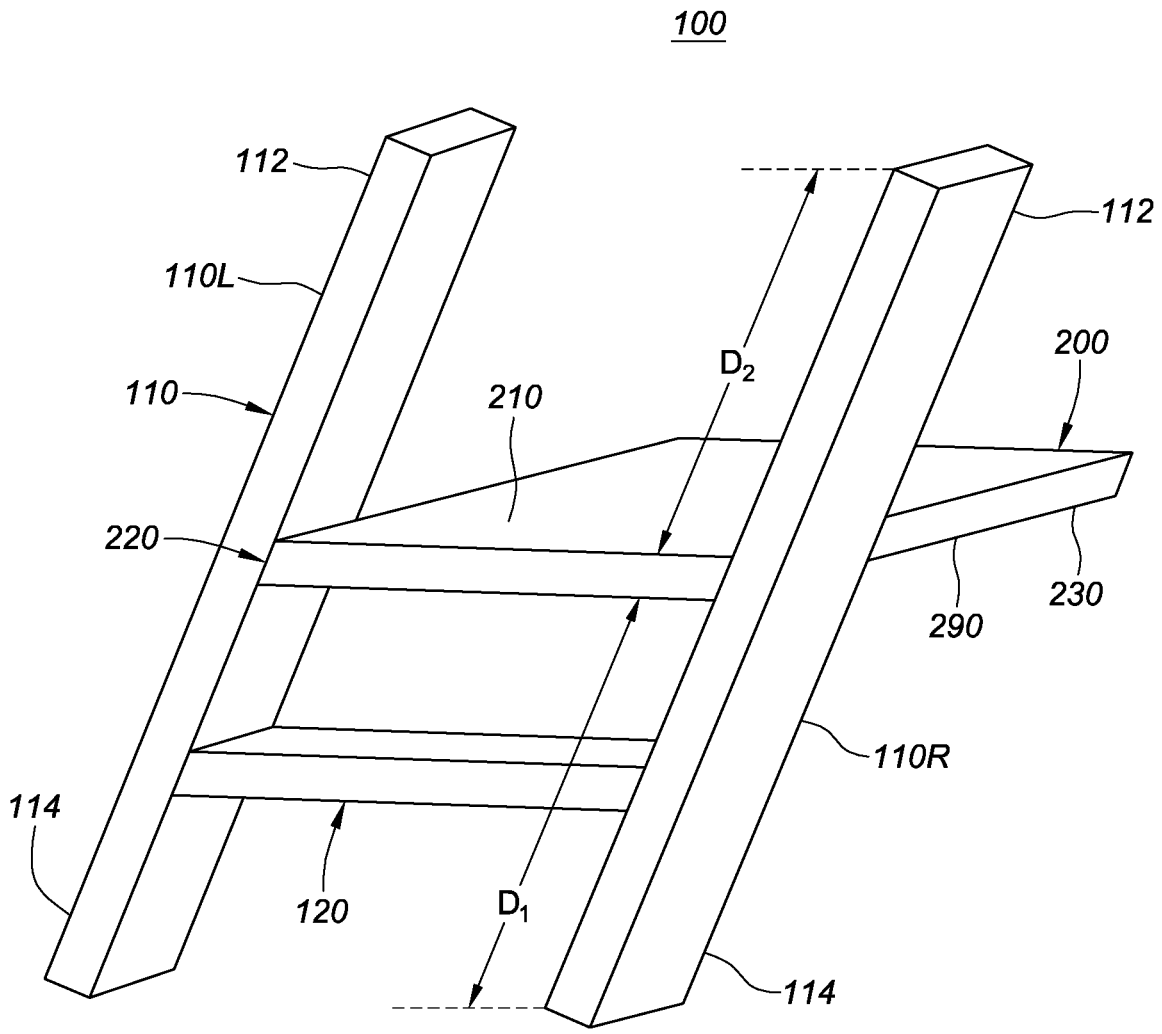
FIG. 12 is an exemplary top-level block diagram illustrating another alternative embodiment of the convertible ladder system of FIGS. 1A-B, wherein the convertible ladder system includes a support platform apparatus.

In some embodiments, the configurable ladder system 100 can include an optional support platform apparatus 200 as illustrated in FIG. 12. The support platform apparatus 200 can include a support platform 290. Being at least partially disposed between the side rails 110, the support platform 290 can have a proximal end region 220 for coupling with the side rails 110 and a distal end region 230 that can extend from the side rails 110 as shown in FIG. 12. The support platform 290 can be made of one or more of the following materials: aluminum; steel; fiberglass; wood; a composite or any other material of suitable strength and durability, without limitation.

The support platform 290 can be fixedly coupled with the side rails 110 and/or rotatably or otherwise adjustably coupled with the side rails 110. If adjustably coupled with the side rails 110, the support platform 290 can comprise a foldable support platform that can transition between a stowed position and a deployed position. In the stowed position, the support platform 290 can be at least partially disposed within an envelope or volume defined by the side rails 110 to facilitate transport of the configurable ladder system 100. Stated somewhat differently, the distal end region 230 of the support platform 290 can be at least partially disposed within the envelope or volume defined by the side rails 110 in the stowed position; whereas, the distal end region 230 can extend from the side rails 110 in the deployed position to facilitate use of the configurable ladder system 100.

The support platform 290 advantageously can provide a standing surface 210 with a predetermined standing surface area. The predetermined standing surface area can be provided with any suitable size, shape and/or dimension, which preferably is larger than a size, shape and/or dimension of a standing surface area provided by the rungs 120. When the support platform 290 extends from the side rails 110 in the deployed position, the standing surface 210 preferably is a plane that is substantially parallel with a plane of the selected support location, such as the base support region 24 (shown in FIGS. 1A-B). The support platform 290 thereby can provide a larger, stable standing area for the user 10 (shown in FIGS. 1A-B) of the configurable ladder system 100 and permit the user 10 to stand closer to the elevated work location 30 (shown in FIGS. 1A-B).

The support platform 290 can be positioned at a preselected first distance Di from the lower end regions 114 of the side rails 110. A predetermined number of the rungs 120 can be disposed between the side rails 110 the preselected first distance $D_1$ from the lower end regions 114 to enable the user 10 to ascend the configurable ladder system 100 and access the support platform 290. As the predetermined number of the rungs 120 increases, the preselected first distance $D_1$ likewise can increase such that the support platform 290 can be positioned adjacent to work locations at greater elevations. The preselected first distance $D_1$, for example, can comprise any preselected distance and/or preselected distance range. According to selected embodiments, exemplary preselected distance ranges can include a selected distance between one foot and twenty feet from the selected support location, including any distance sub-ranges, such as a one-foot sub-range (i.e., between five feet and six feet) and/or a three-foot sub-range (i.e., between three feet and six feet), within the preselected distance range, without limitation.

Additionally and/or alternatively, the support platform 290 can be positioned at a preselected second distance $D_2$ from the upper end regions 112 of the side rails 110. Although the rungs 120 can be distributed along an entire length of the side rails 110, no rungs 120 preferably are disposed between the side rails 110 within the preselected second distance $D_2$ from the upper end regions 112 to facilitate user access to the support platform 290. In one embodiment, the preselected second distance $D_2$ preferably comprises a fixed distance regardless of a total overall height of the configurable ladder system 100. In other words, the preselected second distance $D_2$ can comprise a fixed distance for a range of different preselected first distances $D_1$. The preselected second distance $D_2$, for example, can comprise any preselected distance and/or preselected distance range. Exemplary preselected distance ranges can include a selected distance between two feet and four feet, including any distance sub-ranges, such as a one-foot sub-range (i.e., between two and a half feet and three and a half feet), within the preselected distance range, without limitation.

Figure 13:
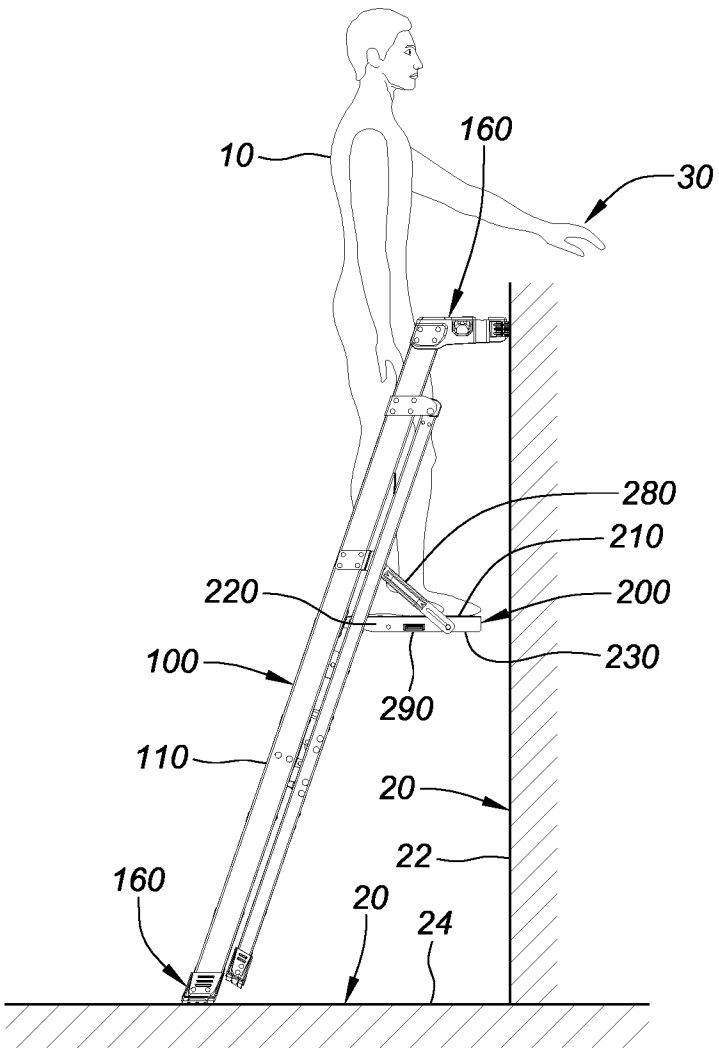
FIG. 13 is an exemplary top-level block diagram illustrating a right-side view of still another alternative embodiment of the convertible ladder system of FIG. 1A, wherein the convertible ladder system includes the support platform apparatus of FIG. 12.

The support platform apparatus 200 can be adapted for use with the configurable ladder system 100 in any of the different ladder configuration modes. FIG. 13, for example, illustrates an alternative embodiment of the configurable ladder system 100 of FIG. 1A. Turning to FIG. 13, the configurable ladder system 100 is shown as being configured for use as a shelf ladder and as further including the support platform apparatus 200. The support platform 290 can be coupled directly to the side rails 110 or, as shown, indirectly via an optional coupling assembly 280.

The coupling assembly 280 can enable the support platform 290 to transition between the stowed position and the deployed position. The coupling assembly 280, in other words, can slidably, rotatably and/or otherwise movably couple the support platform 290 with the side rails 110 of the configurable ladder system 100. The coupling assembly 280 can couple with the proximal end region 220 of the support platform 290 and/or the side rails 110 at one or more points of contact.

In the deployed position, the distal end region 230 of the support platform 290 can extend from the side rails 110 and toward the elevated support region 22. The support platform 290 can provide a larger, stable standing area for the user 10 and, as shown in FIG. 13, permit the user 10 to stand close to the elevated work location 30. The configurable ladder system 100 thereby can enhance user safety.

Figure 14A:
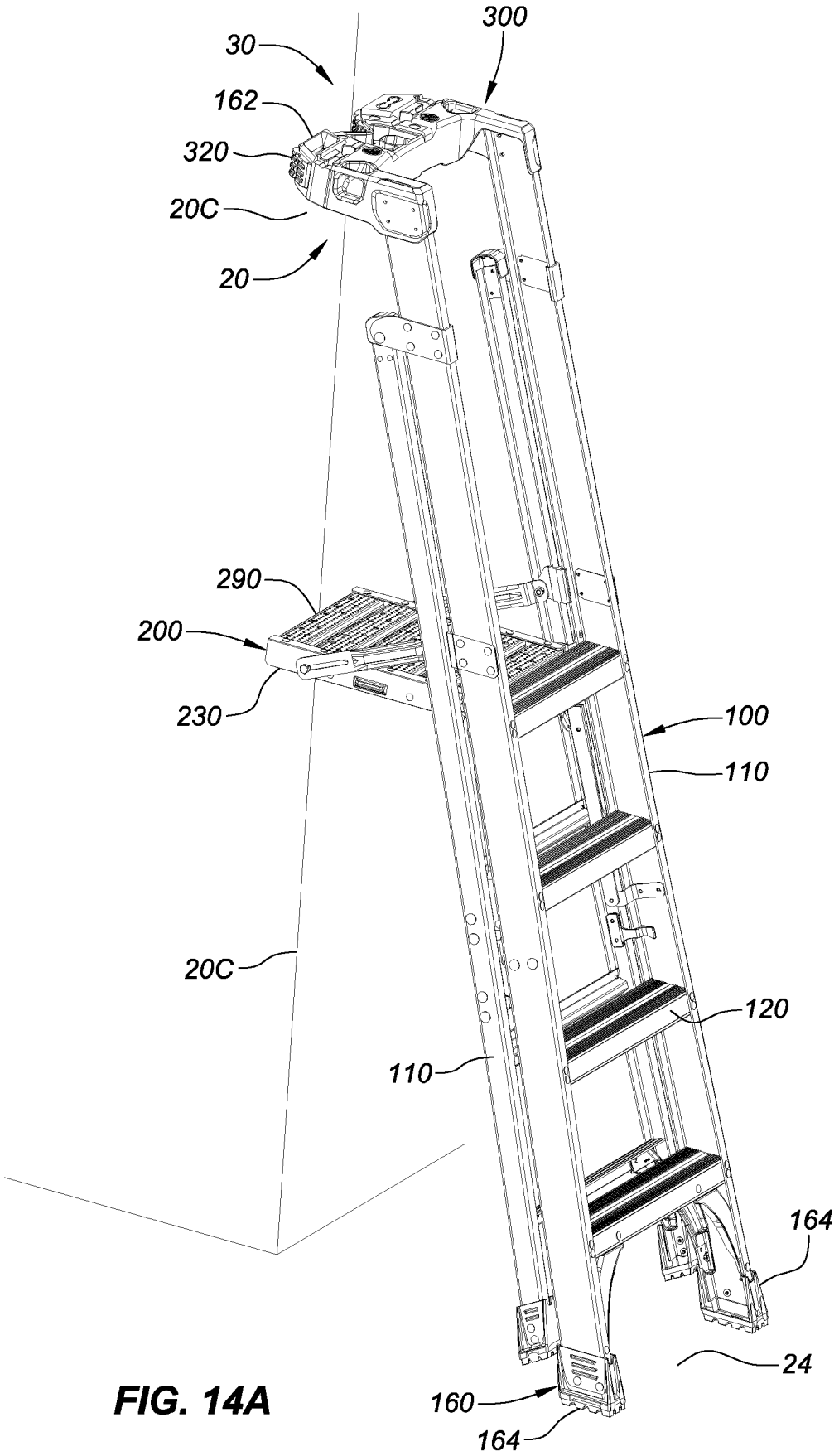
FIG. 14A is an exemplary detail drawing illustrating an embodiment of the convertible ladder system of FIG. 13, wherein the support member is configured to engage an outside corner.

FIG. 14A shows an embodiment of the configurable ladder system 100 that is configured for use as a shelf ladder. The configurable ladder system 100 can include a pair of the side rails 110 each being disposed between the first support member 162 and respective second support members 164. The first support member 162 can be incorporated into the ladder cap apparatus 300 and engage an elevated outside corner 20C adjacent to an elevated work location 30 within the work environment; whereas, the second support members 164 can be configured to engage the floor or other base support region 24 of the work environment. As shown in FIG. 14A, the support platform apparatus 200 can be configured in the deployed position such that the distal end region 230 of the support platform 290 can extend from the side rails 110 and adjacent to the elevated outside corner 20C. The extended support platform apparatus 200 thereby can enable the user 10 (shown in FIG. 13) to stand close to the elevated work location 30 while using the configurable ladder system 100.

Figure 14B:
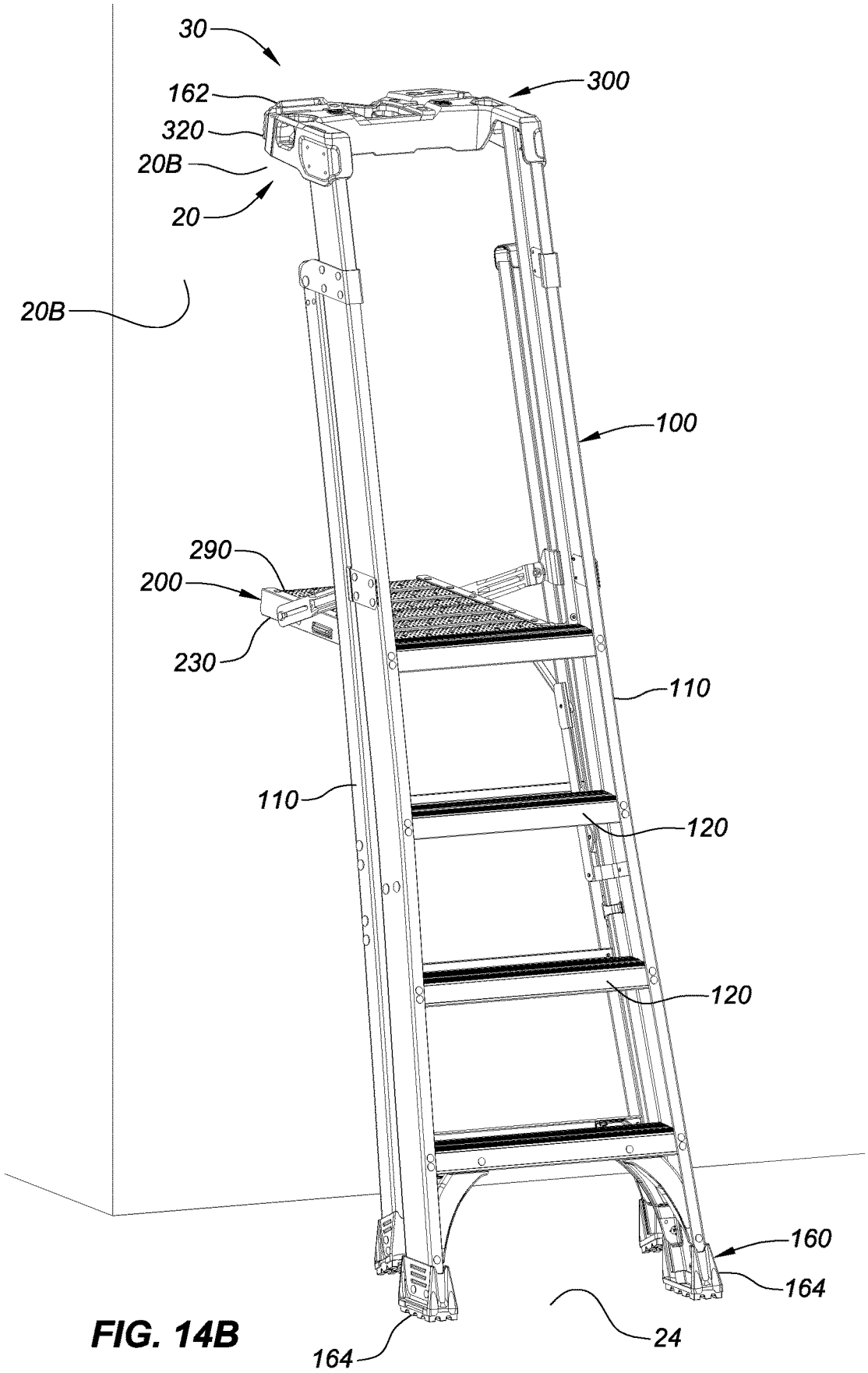
FIG. 14B is an exemplary detail drawing illustrating an alternative embodiment of the convertible ladder system of FIG. 13, wherein the support member is configured to engage a flat surface.

Another alternative embodiment of the configurable ladder system 100 is illustrated in FIG. 14B. Turning to FIG. 14B, the configurable ladder system 100 can be configured for use as a shelf ladder and can include a pair of the side rails 110 each being disposed between the first support member 162 and respective second support members 164. The first support member 162 can be incorporated into the ladder cap apparatus 300 and engage an elevated flat surface 20B adjacent to an elevated work location 30 within the work environment, and the second support members 164 can be configured to engage the floor or other base support region 24 of the work environment. As shown in FIG. 14B, the support platform apparatus 200 can be configured in the deployed position such that the distal end region 230 of the support platform 290 can extend from the side rails 110 and adjacent to the elevated flat surface 20B. The extended support platform apparatus 200 thereby can enable the user 10 (shown in FIG. 13) to stand close to the elevated work location 30 while using the configurable ladder system 100.

Additionally and/or alternatively, the support platform apparatus 200 can be adapted for use with the configurable ladder system 100 in the step ladder mode as shown in FIG.

Figure 15:
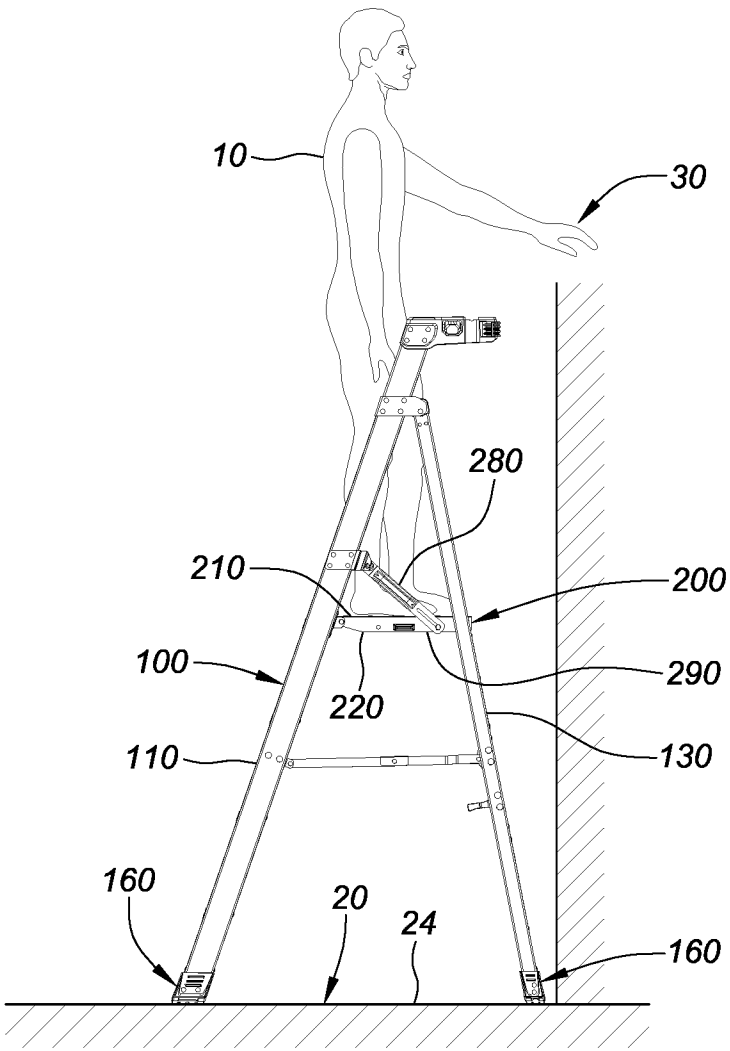
FIG. 15 is an exemplary top-level block diagram illustrating a right-side view of still another alternative embodiment of the convertible ladder system of FIG. 1B, wherein the convertible ladder system includes the support platform apparatus of FIG. 12.

15. FIG. 15 illustrates an alternative embodiment of the configurable ladder system 100 of FIG. 1B, wherein the configurable ladder system 100 further includes the support platform apparatus 200. The support platform 290 can be coupled directly to the side rails 110 or, as shown, indirectly via a coupling assembly 280 in the manner set forth in more detail above with reference to FIG. 13.

The support platform 290 thereby can transition between the stowed position and the deployed position. In the deployed position, the distal end region 230 of the support platform 290 can extend from the side rails 110 and toward the adjustable rails 130 and/or the elevated work location 30. In selected embodiments, the distal end region 230 can rest upon, or otherwise be supported by, one or more of the optional cross-members 138 (shown in FIG. 16A) of the adjustable rails 130. As set forth herein, the support platform 290 can provide a larger, stable standing area for the user 10 and, as shown in FIG. 15, permit the user 10 to stand close to the elevated work location 30, thereby enhancing user safety.

Figure 16A:
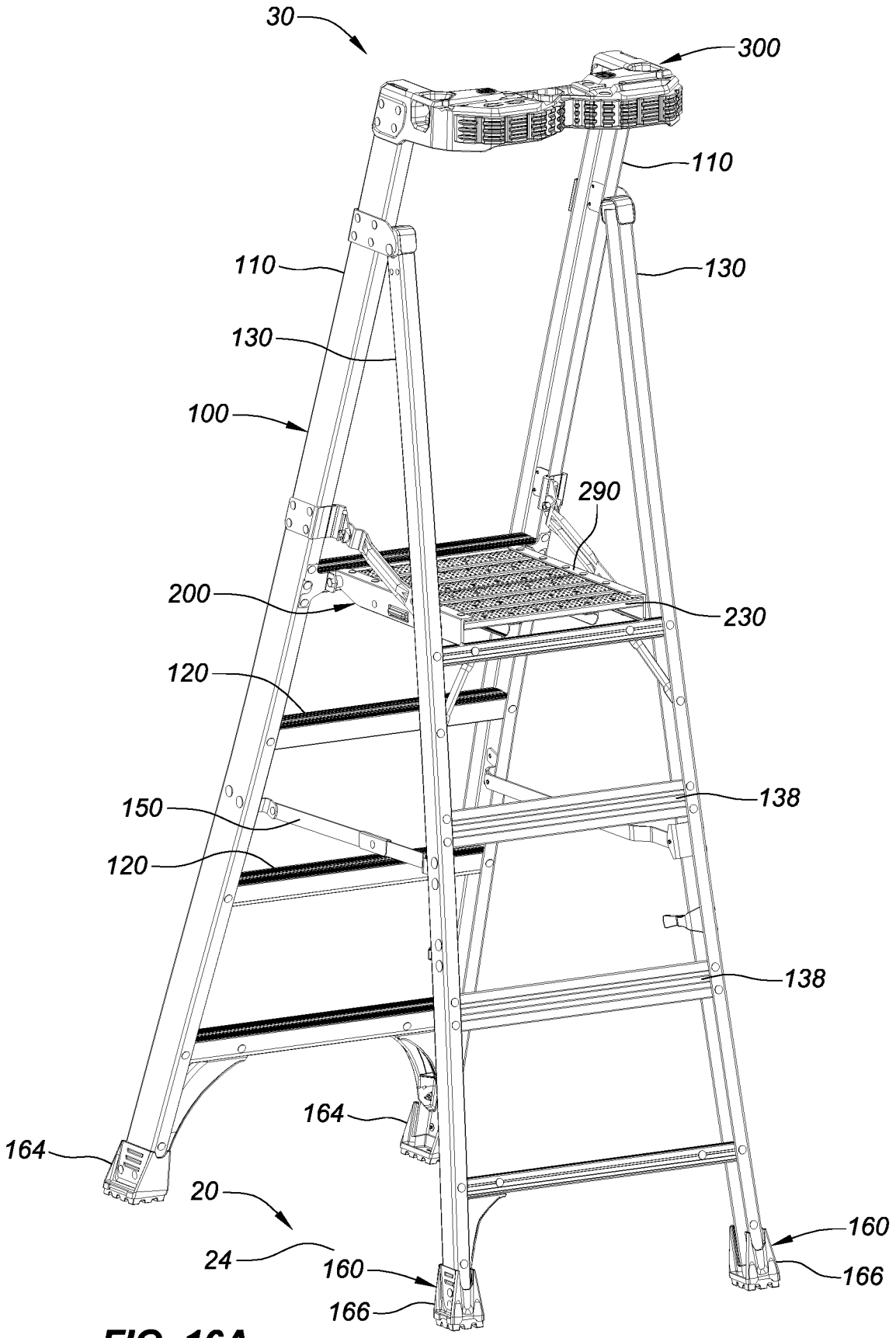
FIG. 16A is an exemplary detail drawing illustrating an embodiment of the convertible ladder system of FIG. 15.

FIG. 16A shows an embodiment of the configurable ladder system 100 that is configured for use as a step ladder. The configurable ladder system 100 can include a pair of the side rails 110 each being disposed between the ladder cap apparatus 300 and respective second support members 164. A pair of the adjustable rails 130 can be separated by, and/or coupled via, the intermediate cross-members 138. The adjustable rails 130 can be disposed between the ladder cap apparatus 300 and respective third support members 166. The second support members 164 and the third support members 166 can be configured to engage the floor or other base support region 24 of the work environment.

As shown in FIG. 16A, the support platform apparatus 200 can be configured in the deployed position. The distal end region 230 of the support platform 290 can extend from the side rails 110 and toward the adjustable rails 130 and/or the elevated work location 30 when the support platform apparatus 200 is in the deployed position. The distal end region 230 preferably can extend between the adjustable rails 130. The extended support platform apparatus 200 thereby can enable the user 10 (shown in FIG. 13) to stand close to the elevated work location 30 while using the configurable ladder system 100.

Figure 16B:
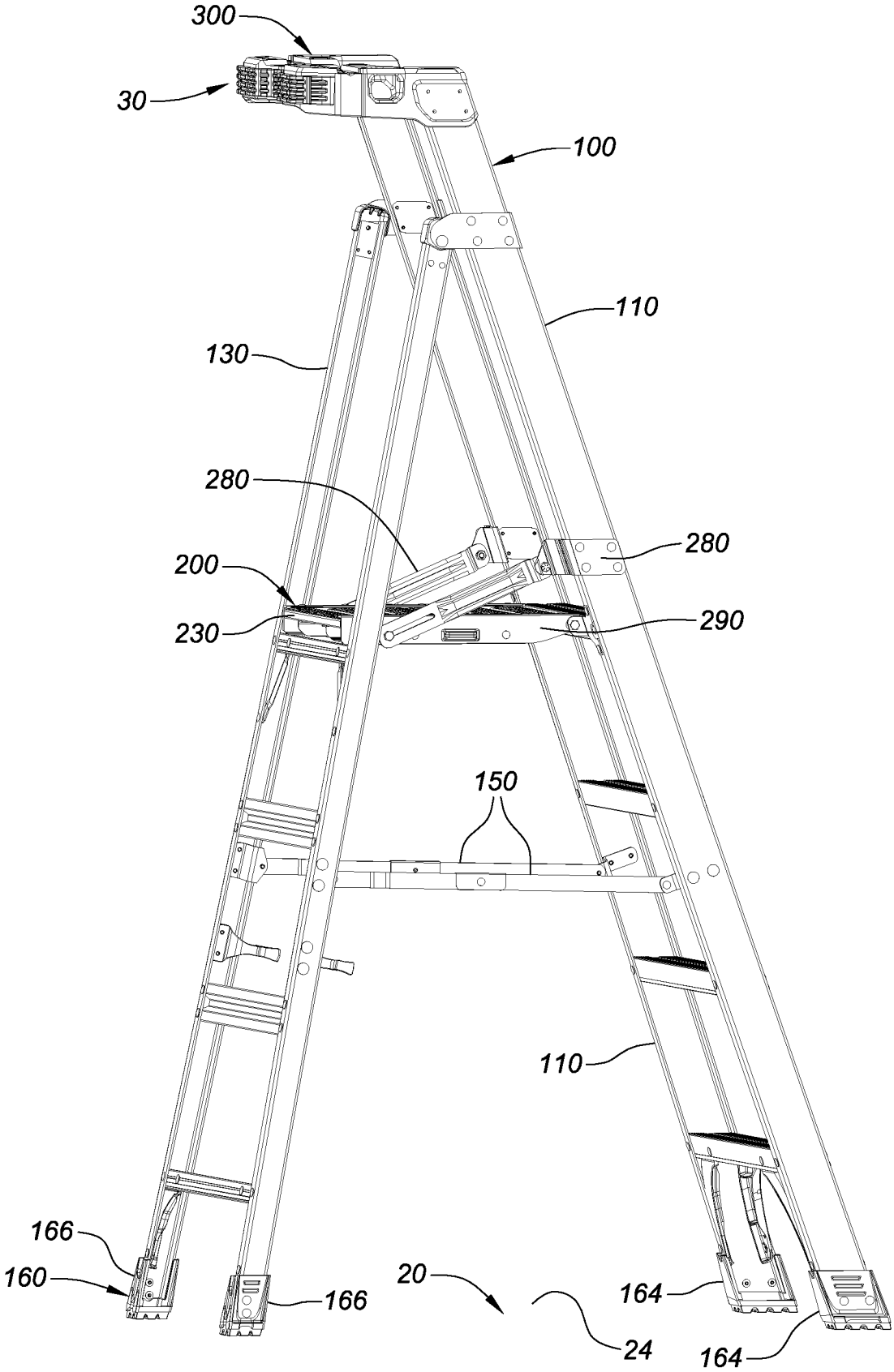
FIG. 16B is an exemplary detail drawing illustrating an alternative embodiment of the convertible ladder system of FIG. 15, wherein the support platform 290 is coupled with the convertible ladder system via a coupling assembly.

Another alternative embodiment of the configurable ladder system 100 is illustrated in FIG. 16B. Turning to FIG. 16B, the configurable ladder system 100 can be configured for use as a step ladder and can include a pair of the side rails 110 and a pair of adjustable rails 130. The side rails 110 can be disposed between the ladder cap apparatus 300 and respective second support members 164, and the adjustable rails 130 can be disposed between the ladder cap apparatus 300 and respective third support members 166. The second support members 164 and the third support members 166 can be configured to engage the floor or other base support region 24 of the work environment.

As shown in FIG. 16B, the configurable ladder system 100 can include the support platform apparatus 200 with the support platform 290. The support platform 290 is shown as being coupled with the side rails 110 via the coupling assembly 280. The coupling assembly 280 can enable the support platform 290 to be configured in the deployed position such that the distal end region 230 of the support platform 290 can extend from the side rails 110 and toward the adjustable rails 130 and/or the elevated work location 30. The extended support platform apparatus 200 thereby can enable the user 10 (shown in FIG. 13) to stand close to the elevated work location 30 while using the configurable ladder system 100.

Figure 17A:
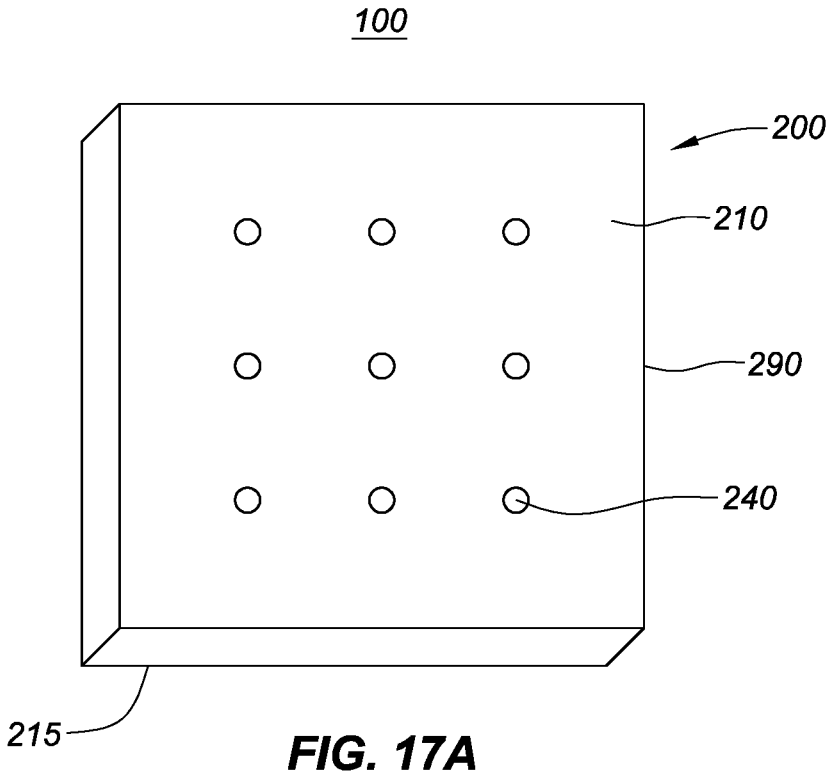
FIG. 17A is an exemplary top-level block diagram illustrating an alternative embodiment of the ladder system of FIG. 12, wherein the support platform apparatus can define one or more openings.

FIG. 17A illustrates an alternative embodiment of the support platform apparatus 200, wherein the support platform 290 can define one or more openings 240. The openings 240 advantageously can provide drainage for any liquid, solid or other material (not shown) that might appear on the standing surface 210. The material, for example, can include any rain, snow, dirt, spilled paint or oil, a solid fastener or any other type of accumulated material that could present a slip and fall hazard. By providing drainage, the support platform apparatus 200 can help divert the accumulated material away from a user, such as the feet of the user, of the configurable ladder system 100 and thus enhance user safety.

The openings 240 can be defined with any suitable predetermined size, shape and/or dimension that can be uniform and/or different among the openings 240. Although each opening 240 can have a size, shape and/or dimension that is suitable for draining accumulated water, snow, rain and/or dirt, for example, a first opening 240 with a larger dimension might be more suitable for draining a thicker spilled liquid; whereas, a second opening 240 with an elongated shape might be more suitable for draining the accumulated water, snow, rain or dirt and/or a dropped metal fastener, such as a nail or screw. To facilitate drainage, the openings 240 preferably extend through the support platform 290 from the standing surface 210 to a lower surface 215 of the support platform 290 opposite the standing surface 210. The openings 240 optionally can be defined in a regular and/or irregular pattern. In one embodiment, the openings 240 can be divided into a group of openings 240. The group of openings 240 can have a preselected pattern and can be repeated across the support platform 290.

Figure 17B:
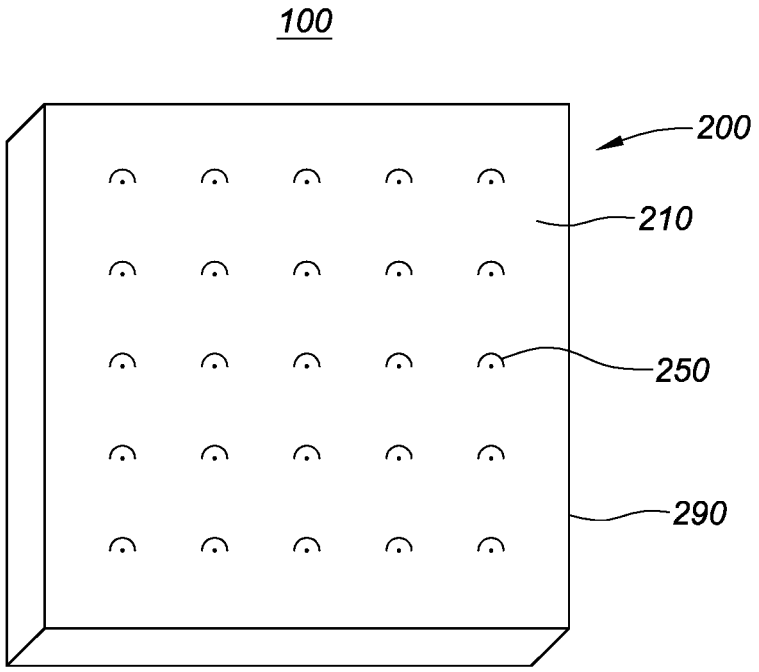
FIG. 17B is an exemplary top-level block diagram illustrating another alternative embodiment of the ladder system of FIG. 12, wherein at least one extension member extends from the support platform apparatus.

Another alternative embodiment of the support platform apparatus 200 is illustrated in FIG. 17B. Turning to FIG. 17B, the support platform 290 is shown as including one or more raised or extension members 250. The extension members 250 can extend from the standing surface 210 of the support platform 290 and thereby enhance an engagement between the support platform apparatus 200 and the user, such as footwear worn by the user. In one embodiment, the extension members 250 can extend perpendicularly from the standing surface 210. By enhancing the engagement between the standing surface 210 and the user, the support platform apparatus 200 can help enhance user safety.

The extension members 250 can be provided with any suitable predetermined size, shape and/or dimension that can be uniform and/or different among the extension members 250.

The extension members 250 optionally can be provided in a regular and/or irregular pattern. In one embodiment, the extension members 250 can be divided into a group of extension members 250. The group of extension members 250 can have a preselected pattern and can be repeated across the support platform 290. In a selected embodiment, the extension members 250 can help to reduce any slip and fall hazard that might arise from accumulated material in the manner described above with reference to FIG. 17A. Here, the extension members 250 can form a physical separation between the user and any accumulated material on the standing surface 210.

Figure 18A:
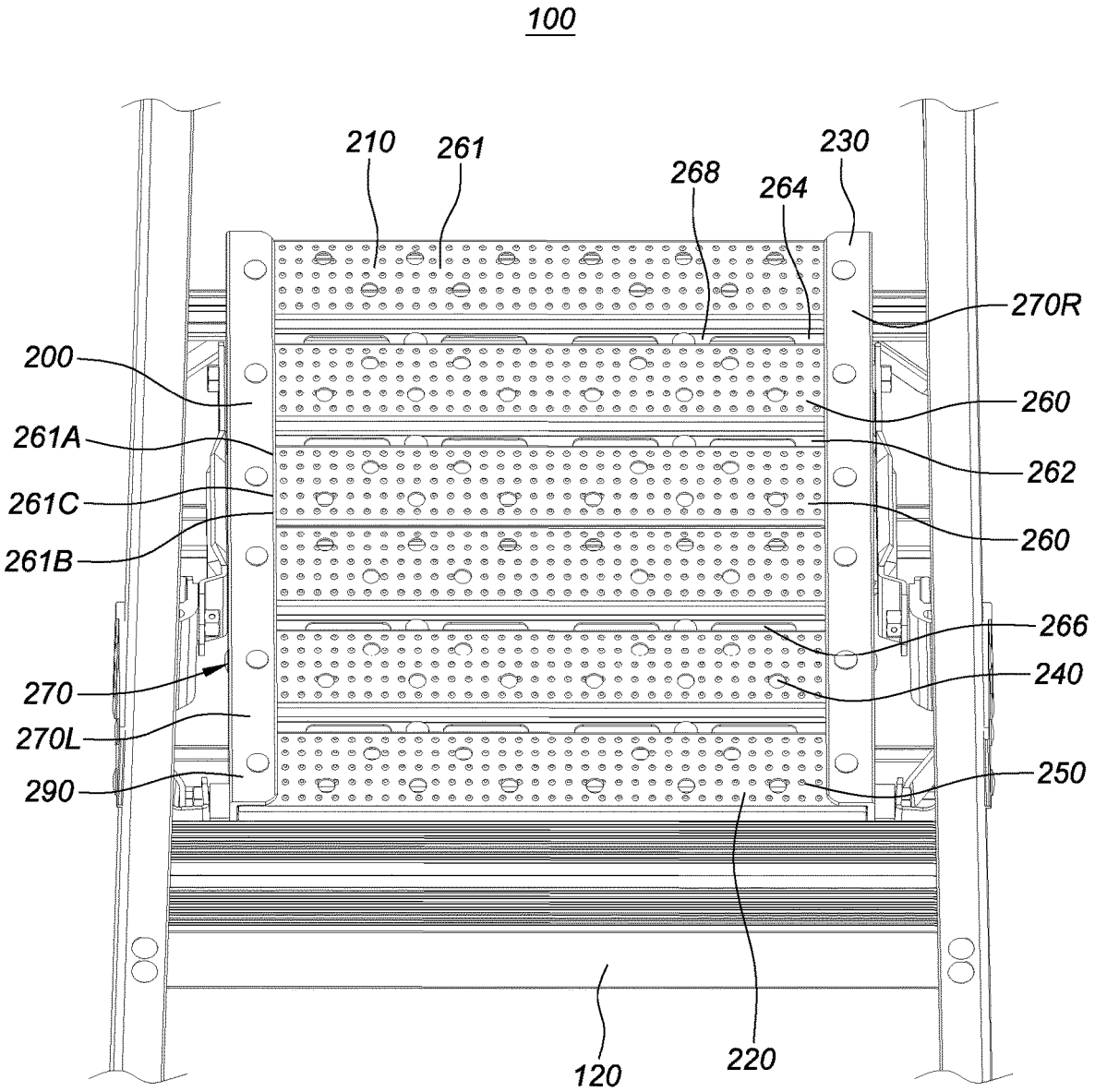
FIGS. 18A-B are an exemplary top-level block diagram illustrating still another alternative embodiment of the ladder system of FIG. 12, wherein the support platform apparatus comprises a plurality of support platform apparatus members.
Figure 18B:
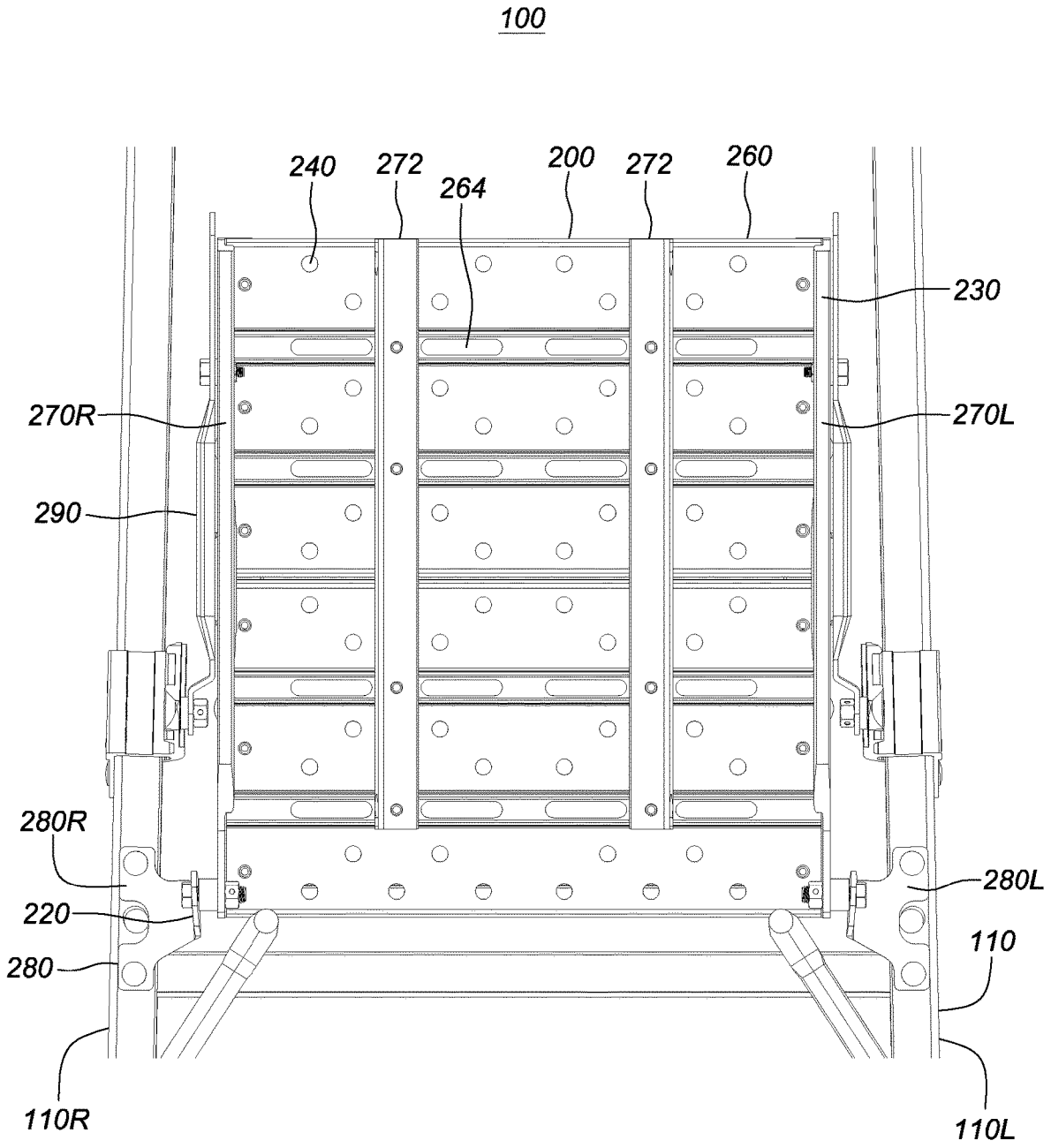

FIGS. 18A-B illustrate still another alternative embodiment of the support platform apparatus 200, wherein the support platform 290 comprises a plurality of support platform apparatus members 260. The support platform apparatus members 260 can comprise separate members and/or can include one or more integrated members as shown in FIGS. 18A-B. If provided as integrated members, adjacent support platform apparatus members 260 can be coupled via an intermediate coupling member 262. The support platform apparatus members 260 and the intermediate coupling members 262, for example, can be formed from a single piece of material. One or more of the support platform apparatus members 260 can define the optional openings 240 in the manner set forth herein with reference to FIG. 17A and/or include the optional extension members 250 in the manner set forth herein with reference to FIG. 17B.

Each of the support platform apparatus members 260 can provide respective standing surfaces 261. The standing surfaces 261 of the support platform apparatus members 260 can define predetermined surface areas that can be uniform and/or different among the support platform apparatus members 260. The standing surfaces 261 can be aggregated to provide the standing surface 210 of the support platform 290. The support platform apparatus members 260 can span between the proximal end region 220 and the distal end region 230 of the support platform 290. In a preferred embodiment, one or more selected support platform apparatus members 260 associated with the proximal end region 220 of the support platform 290 can be positioned adjacent to a selected rung 120. The selected support platform apparatus members 260 can be in physical contact with, or separated by a predetermined distance from, the selected rung 120 as desired. A standing surface area of the selected rung 120 can be aggregated with the standing surfaces 261 to extend the standing surface 210 of the support platform 290.

As illustrated in FIG. 18A, the standing surface 261 of one or more of the support platform apparatus members 260 can include a central standing surface 261C that can be disposed between, and elevated relative to, peripheral standing surfaces 261A, 261B. The standing surfaces 261A-C, for example, can define a convex profile (or contour). The standing surfaces 261A-C thereby can direct any liquid, solid or other material (not shown) that might appear on the standing surface 261 away from the central standing surface 261C and toward the peripheral standing surfaces 261A, 261B. The support platform apparatus members 260 thereby can help to reduce any slip and fall hazard that might arise from accumulated material in the manner described above with reference to FIG. 17A. By providing material drainage for the support platform apparatus 200, the support platform apparatus members 260 can help enhance user safety.

In some embodiments, the standing surfaces 261A-C of adjacent support platform apparatus members 260 can be adapted to direct any material accumulated on the support platform apparatus members 260 toward the intermediate coupling member 262. The intermediate coupling member 262 as shown in FIG. 18A can form a channel 264 for receiving the accumulated material. Stated somewhat differently, the accumulated material directed toward the peripheral standing surfaces 261A, 261B of the adjacent support platform apparatus members 260 can be further directed toward, and received by, the channel 264.

The channel 264 can be formed with a suitable size, shape and/or dimension for receiving the accumulated material. For example, the size, shape and/or dimension of the channel 264 can be suitable to receive the accumulated material, including liquid and/or solid materials, such as accumulated water, snow, rain, dirt and/or one or more dropped solid fasteners. The accumulated material preferably is completely disposed within the channel 264 such that the user of the configurable ladder system 100 does not contact the accumulated material disposed within the channel 264. By helping to divert the accumulated material away from the user, the channel 264 can further enhance user safety.

Alternatively and/or additionally, at least one selected intermediate coupling member 262 can define one or more optional openings 266. The openings 266, for example, can be defined in a lower region 268 of the selected intermediate coupling member 262 coupling the adjacent support platform apparatus members 260 and/or can communicate with the channel 264. The openings 266 advantageously can provide drainage for any liquid, solid or other material that might be received by the channel 264 in the manner set forth in more detail above with reference to the openings 240 (shown in FIG. 17A). By providing the drainage, a capacity of the channel 264 can be increased beyond a physical volume of the channel 264. The channel 264, in other words, can divert an amount of accumulated material that exceeds a capacity of the channel 264.

The openings 266 can be defined with any suitable predetermined size, shape and/or dimension that can be uniform and/or different among the openings 266. Although each opening 266 can have a size, shape and/or dimension that is suitable for draining accumulated water, snow, rain and/or dirt, for example, a first opening 266 with a larger dimension might be more suitable for draining a thicker spilled liquid; whereas, a second opening 266 with an elongated shape might be more suitable for draining the accumulated water, snow, rain or dirt. To facilitate drainage, the openings 266 preferably extend through the lower region 268 of the selected intermediate coupling member 262. The openings 266 optionally can be defined in a regular and/or irregular pattern. In one embodiment, the openings 266 can be divided into a group of openings 266. The group of openings 266 can have a preselected pattern and can be repeated across the selected intermediate coupling member 262.

As illustrated in FIGS. 18A-B, the support platform 290 can include one or more optional bracket members 270, 272. The bracket members 270, 272 can provide additional structural support (or reinforcement) for the support platform 290 and/or provide an interface for coupling the support platform 290 with the side rails 110 of the configurable ladder system 100. Side bracket members 270R, 270L, for example, can be connected with opposite side regions of the support platform 290. Stated somewhat differently, the support platform apparatus members 260 can include opposite end regions that can be coupled via the side bracket members 270R, 270L as shown. The right-hand bracket member 270R can couple with the right-hand side rail 110R of the configurable ladder system 100; whereas, the left-hand bracket member 270L can couple with the left-hand side rail 110L of the configurable ladder system 100. One or more central bracket members 272 can be centrally disposed on the support platform 290 (such as, for example, at the lower surface 215 of the support platform 290) and between the side bracket members 270.

The bracket members 270 can be connected with the configurable ladder system 100 directly and/or indirectly via a coupling assembly 280 for enabling the support platform 290 to transition between the stowed position and the deployed position. The coupling assembly 280, in other words, can slidably, rotatably and/or otherwise movably couple the support platform 290 with the side rails 110 of the configurable ladder system 100. As illustrated in FIG. 18B, for example, the side bracket members 270R, 270L can be coupled with the side rails 110R, 110L via respective coupling assemblies 280R, 280L. The coupling assembly 280 can couple with the side rails 110 at one or more points of contact.

Although shown and described above as including a pair of side rails 110 for purposes of illustration only, the configurable ladder system 100 can comprise any conventional type of ladder, such as a platform ladder, an extension ladder, a shelf ladder, a step ladder, a step stool or a telescoping ladder, without limitation, and/or can include any predetermined number of side rails 110 and/or rungs 120. In selected embodiments, the configurable ladder system 100 can comprises a convertible ladder system that can be configured into any of a plurality of different configuration modes (or ladder types). The configuration mode of the configurable ladder system 100 can be based upon one or more predetermined criteria, such as an intended use (or purpose) of the configurable ladder system 100 and/or an intended work environment. The configurable ladder system 100 can be changed from a first configuration mode to a second configuration mode, for example, if the configurable ladder system 100 is to be used for a different purpose and/or within a different work environment. In a preferred embodiment, the configurable ladder system 100 can support any predetermined number of different configuration modes.

Figure 19:
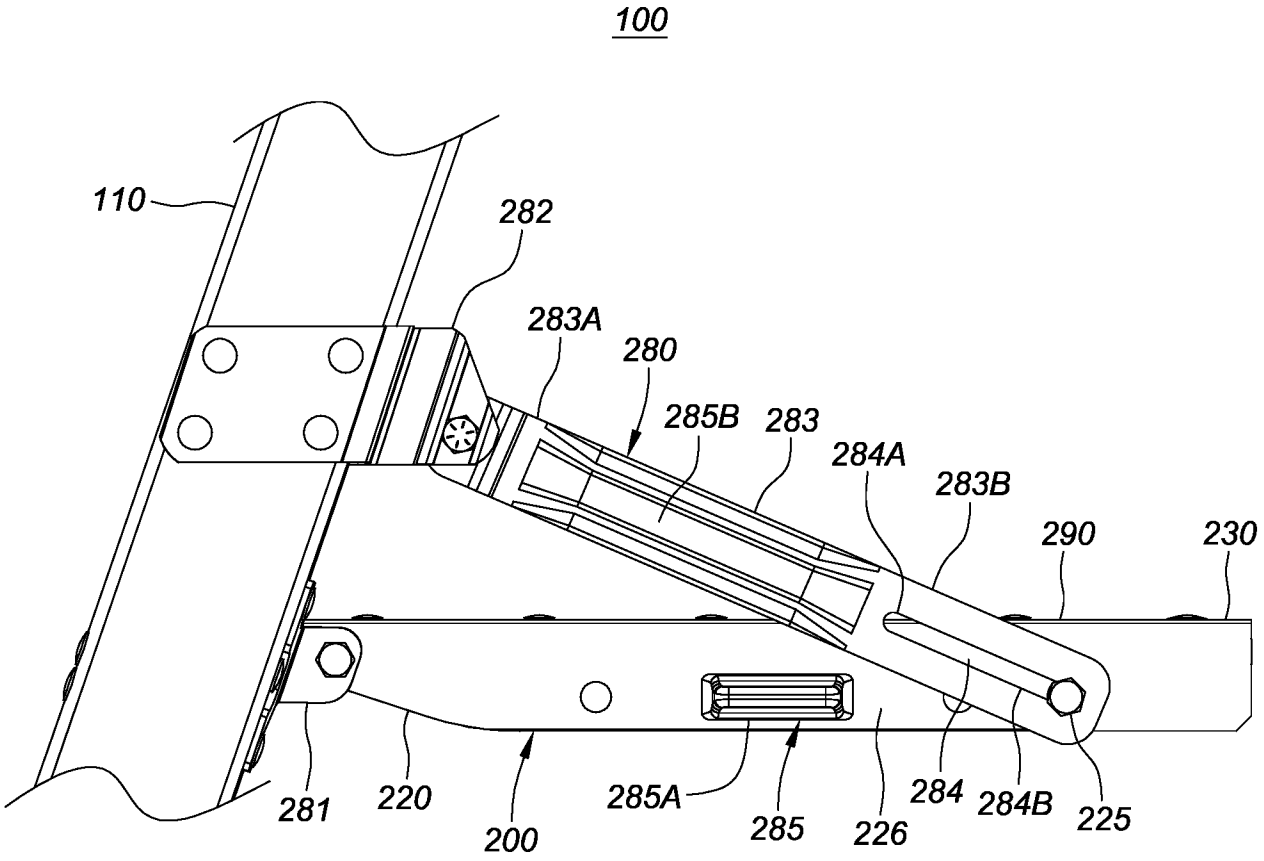
FIG. 19 is an exemplary detail drawing illustrating an embodiment of the coupling assembly of FIG. 16B.

An exemplary embodiment of the coupling assembly 280 for coupling the support platform 290 with the side rails 110 is shown in FIG. 19. Turning to FIG. 19, the coupling assembly 280 is shown as including a first coupling member 281. The first coupling member 281 can couple the proximal end region 220 of the support platform 290 with a first predetermined region of a selected side rail 110. The first predetermined region of the selected side rail 110 preferably is disposed at the preselected first distance $D_1$ (shown in FIG. 12) from the lower end region 114 (shown in FIG. 12) of the selected side rail 110. The first coupling member 281 can provide support for the support platform 290 while enabling the support platform 290 to rotate relative to the selected side rail 110.

Additionally and/or alternatively, the coupling assembly 280 can include a second coupling member 282 for providing supplemental support for the support platform 290. The second coupling member 282 can couple the selected side rail 110 with the support platform 290 at the distal end region 230 or any other preselected platform region distal of the proximal end region 220. The second coupling member 282 is shown as being disposed at a second predetermined region of the selected side rail 110 that is offset from the first predetermined region of the selected side rail 110. In other words, the second coupling member 282 can be displaced from the first coupling member 281 by a predetermined distance along the selected side rail 110.

As illustrated in FIG. 19, the second coupling member 282 can couple the selected side rail 110 and the support platform 290 via an elongated coupling member 283. The elongated coupling member 283 can include a first and second end regions 283A, 283B. The first end region 283A of the elongated coupling member 283 can be rotatably coupled with the second coupling member 282. In other words, the second coupling member 282 enables the elongated coupling member 283 to rotate relative to the selected side rail 110. The second end region 283B of the elongated coupling member 283 can be slidably coupled with the support platform 290.

In selected embodiments, the second end region 283B of the elongated coupling member 283 can define an elongated channel 284. An extension coupling member 225 can extend from a side region 226 of the support platform 290. The extension coupling member 225 can be disposed within, and slidably or otherwise movable engage, the elongated channel 284 of the elongated coupling member 283. Stated somewhat differently, the extension coupling member 225 can move within the elongated channel 284 between a first end location 284A of the elongated channel 284 and a second end location 284B of the elongated channel 284. The coupling assembly 280 thereby can enable the support platform 290 to move between the stowed and deployed positions and provide support for the support platform 290 in the deployed position.

Figure 20A:
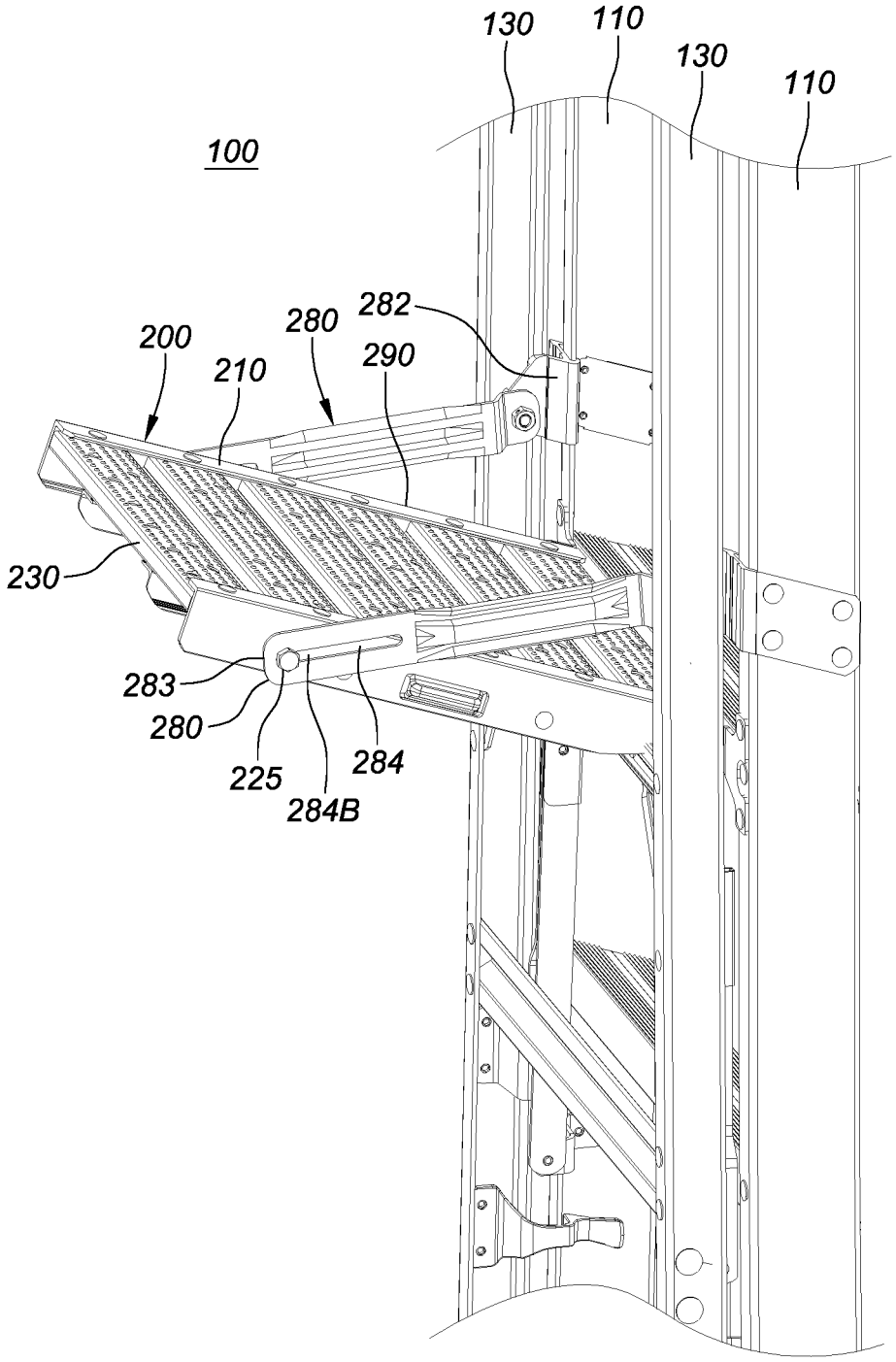
FIG. 20A is an exemplary detail drawing illustrating an embodiment of the coupling assembly of FIG. 19, wherein the support platform is disposed in a deployed position.

Although shown and described with reference to FIG. 19 as including a single coupling assembly 280 for purposes of illustration only, the configurable ladder system 100 can include any predetermined number of the coupling assemblies 280. As shown in FIG. 20A, for example, each side rail 110 of the configurable ladder system 100 can have a respective the coupling assembly 280 for coupling the side rail 110 with the support platform 290. In selected embodiments, the coupling assembly 280R associated with the right-hand side rail 110R of the configurable ladder system 100 can comprise a mirror image of the coupling assembly 280L associated with the left-hand side rail 110L (collectively shown in FIG. 18B).

The configurable ladder system 100 of FIG. 20A is shown with the support platform 290 being disposed in the deployed position. When the support platform 290 is disposed in the deployed position, the extension coupling member 225 can be positioned adjacent to the second end location 284B of the elongated channel 284 defined by the elongated coupling member 283. The elongated coupling member 283 thereby can inhibit further downward rotation of the support platform 290, such as a rotation of the support platform 290 toward the floor or other base support region 24 of the work environment, relative to the first coupling member 281 (shown in FIG. 19). In other words, the interaction between the extension coupling member 225 and the elongated channel 284 can provide support for the support platform 290 in the deployed position, resisting further rotation of the support platform 290 relative to the first coupling member 281 if additional weight or other force is applied to the standing surface 210.

Figure 20B:
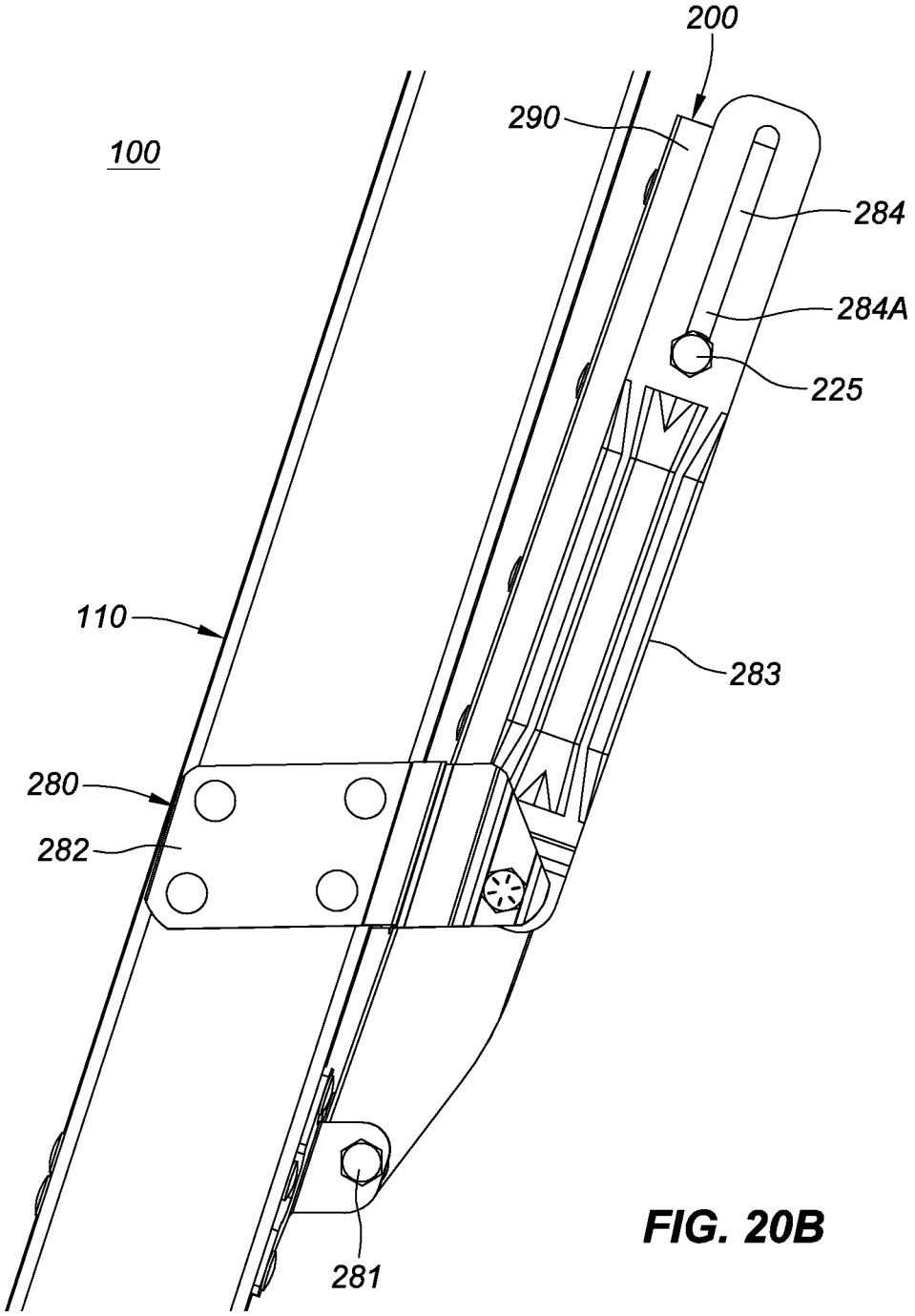
FIG. 20B is an exemplary detail drawing illustrating an alternative embodiment of the coupling assembly of FIG. 19, wherein the support platform is disposed in a stowed position.

Turning to FIG. 20B, the configurable ladder system 100 is illustrated with the support platform 290 being disposed in the stowed position. When the support platform 290 is disposed in the stowed position, the extension coupling member 225 can be positioned adjacent to the first end location 284A of the elongated channel 284 defined by the elongated coupling member 283. The elongated coupling member 283 thereby can inhibit further rotation of the support platform 290 relative to the first coupling member 281. Stated somewhat differently, the interaction between the extension coupling member 225 and the elongated channel 284 can prevent a rotation of the support platform 290 beyond the envelope or volume defined by the side rails 110 and/or adjustable rails 130 of the configurable ladder system 100.

Returning briefly to FIG. 19, the coupling assembly 280 is illustrated as including an optional locking system 285 for maintaining the support platform 290 in the stowed position. In selected embodiments, the locking system 285 can retain the support platform 290 in the stowed position until intended for use. The locking system 285 thereby can further facilitate transport of the configurable ladder system 100. The support platform 290, when locked in the stowed position, can be readily unlocked for enabling transition to the deployed position as desired.

The locking system 285, for example, can include a retractable locking member 285A for engaging a locking recess 285B defined by the elongated coupling member 283. In selected embodiments, the retractable locking member 285A can extend from the side region 226 of the support platform 290. The retractable locking member 285A is distal from the locking recess 285B when the support platform 290 is disposed in the deployed position. While transitioning from the deployed position to the stowed position, the elongated coupling member 283 and the side region 226 of the support platform 290 can converge as illustrated in FIGS. 20A-B.

As the convergence continues, the retractable locking member 285A can begin to engage the elongated coupling member 283 and to retract into the support platform 290. The retractable locking member 285A, for example, can include a first sloped (or angled) periphery 286 for facilitating the retraction as the elongated coupling member 283 and the side region 226 of the support platform 290 converge. The retractable locking member 285A can retract sufficiently to permit the elongated coupling member 283 and the side region 226 of the support platform 290 to continue to converge. As the convergence further proceeds, the retractable locking member 285A can become at least partially aligned with the locking recess 285B defined by the elongated coupling member 283.

Once suitably aligned with the locking recess 285B, the retractable locking member 285A can reverse the retraction into the support platform 290 and again extend from the side region 226 of the support platform 290. The retractable locking member 285A thereby can be received within the locking recess 285B and engage the elongated coupling member 283. The engagement between the retractable locking member 285A and the elongated coupling member 283 can help to maintain the support platform 290 in the stowed position in the manner set forth above.

The locking system 285 advantageously can enable the support platform 290 to exit the stowed position, as desired. A second sloped (or angled) periphery 287 of the retractable locking member 285A, for example, can facilitate removal of the retractable locking member 285A from within the locking recess 285B. When sufficient force is applied to the support platform 290, the retractable locking member 285A can again begin to engage the elongated coupling member 283 and to retract into the support platform 290. The retractable locking member 285A can retract sufficiently to permit the elongated coupling member 283 and the side region 226 of the support platform 290 to continue to diverge. As the divergence further proceeds, the retractable locking member 285A can become distal from the locking recess 285B and again extend from the side region 226 of the support platform 290. The support platform 290 thereby can be readily unlocked for enabling transition to the deployed position as desired.

Figure 21A:
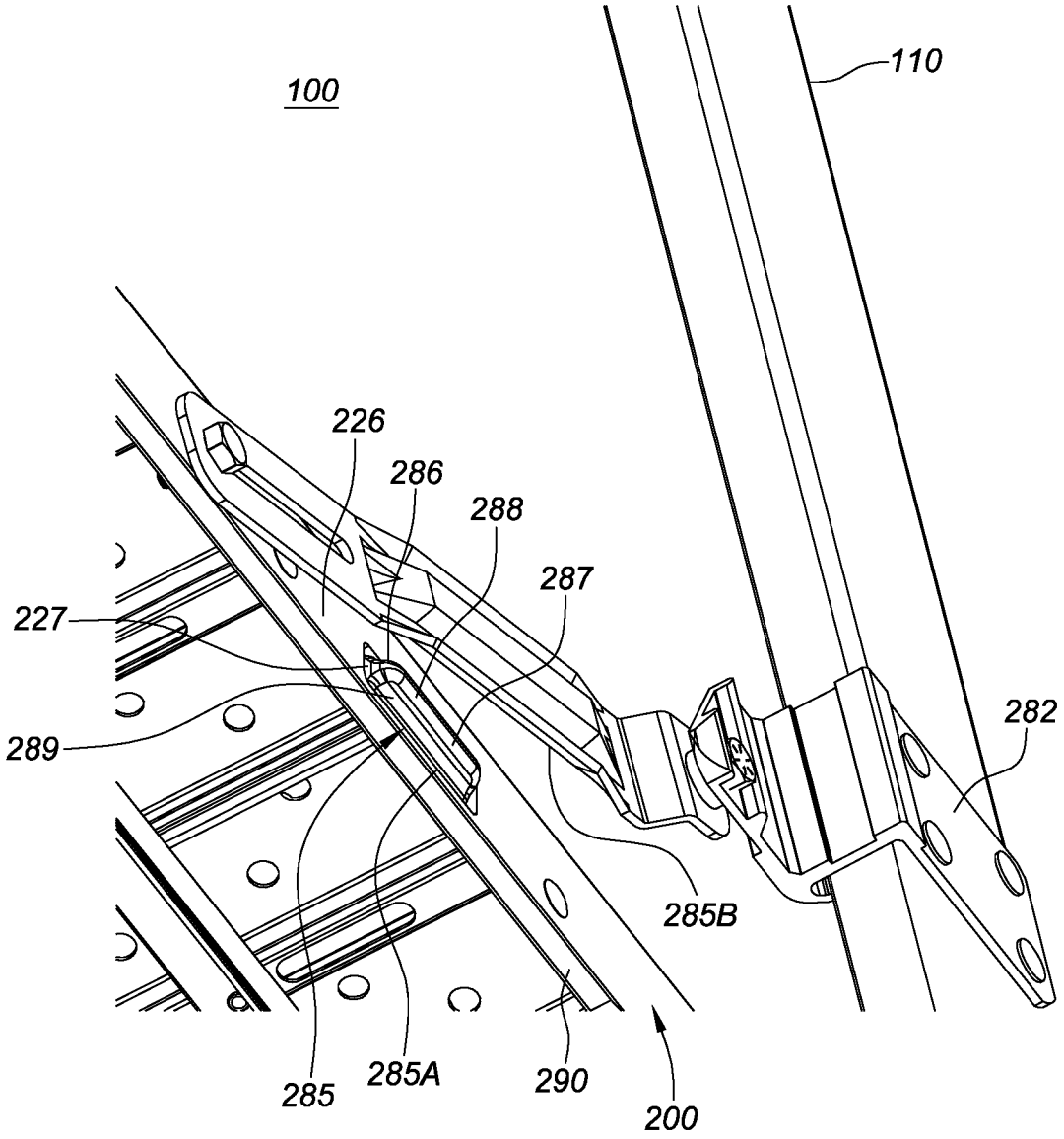
FIGS. 21A-B are an exemplary detail drawings illustrating another alternative embodiment of the coupling assembly of FIG. 19, wherein the coupling assembly includes a locking system for maintaining the support platform in the stowed position.
Figure 21B:
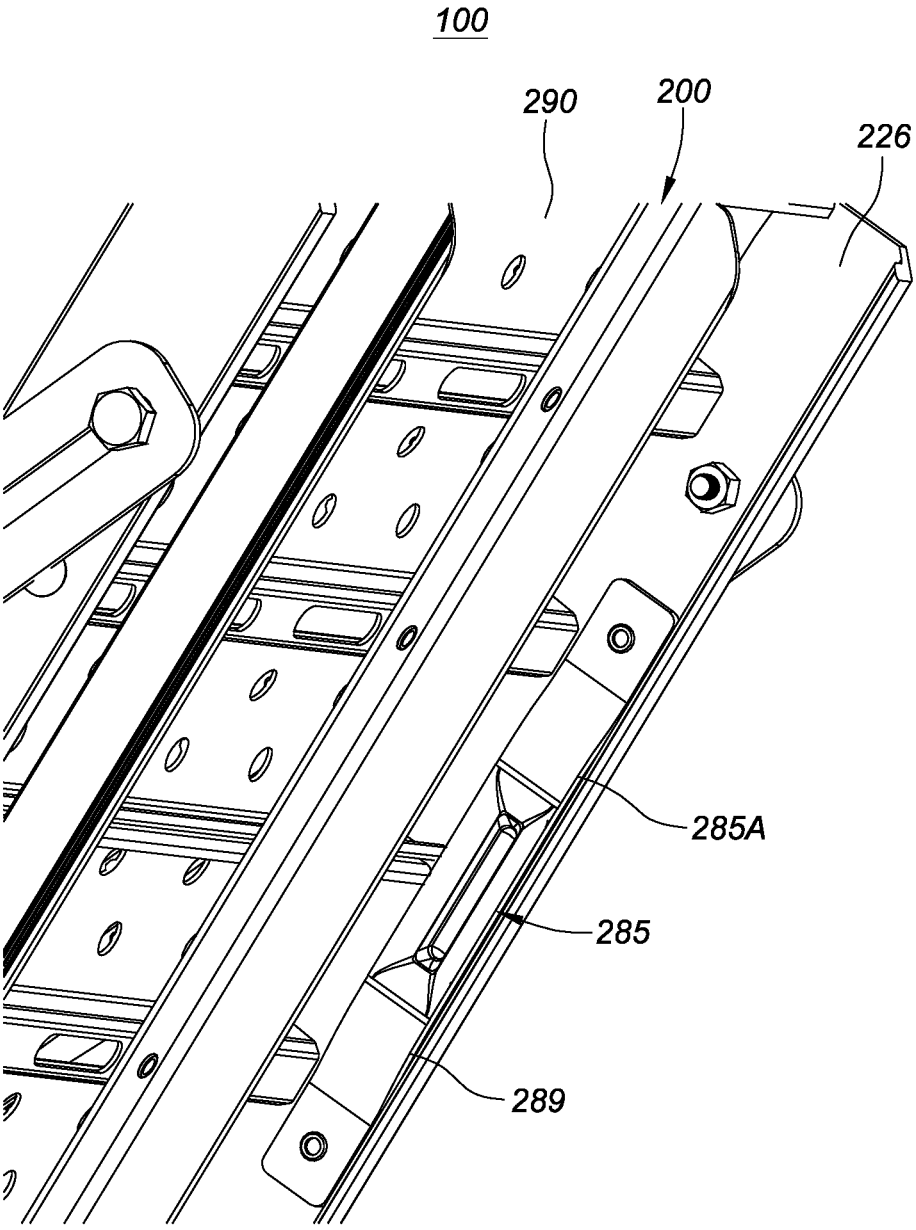

A preferred embodiment of the locking system 285 is illustrated in FIGS. 21A-B. Turning to FIGS. 21A-B, the retractable locking member 285A can be provided via an elongated member 289 that comprises a resilient or otherwise flexible material. The elongated member 289 can include a raised central portion 288 disposed between opposite end regions. The central portion 288 can define the first and second sloped peripheries 286, 287 and can extend through an opening 227 formed in the side region 226. The opposite end regions of the elongated member 289 can be coupled with the side region 226. The sloped periphery 286 of the retractable locking member 285A thereby can engage the locking recess 285B defined by the elongated coupling member 283 and retract into the support platform 290 in the manner described above with reference to FIG. 19.

The disclosed embodiments are susceptible to various modifications and alternative forms, and specific examples thereof have been shown by way of example in the drawings and are herein described in detail. It should be understood, however, that the disclosed embodiments are not to be limited to the particular forms or methods disclosed, but to the contrary, the disclosed embodiments are to cover all modifications, equivalents, and alternatives.

What is claimed is:

1. A configurable ladder system, comprising:

a first pair of elongated side rails being coupled via a plurality of intermediate rungs and comprising a first upper end region with an upper support member for engaging an elevated support region within a work environment and a first lower end region that is opposite the first upper end region and that includes a first lower support member for engaging a base support region within the work environment;

a second pair of elongated side rails being coupled via a plurality of intermediate cross-members and comprising a second upper end region being rotatably coupled with said first pair of side rails between the first upper end region and the first lower end region and a second lower end region that is opposite the second upper end region and that includes a second lower support member for engaging the base support region; and a support platform having a distal end region and a proximal end region being disposed between said first pair of elongated side rails at a predetermined distance from the first upper end region and being adjustable between a stowed position in which said support platform is disposed within an envelope defined by said first pair of elongated side rails for facilitating transport of the ladder system and a deployed position in which the distal end region of said support platform extends from said first pair of elongated side rails for providing a standing surface during use in the step ladder configuration and in the shelf ladder configuration, wherein the ladder system is configured to transition between a step ladder configuration and a shelf ladder configuration, and either:

wherein said support platform comprises a plurality of standing surface members with adjacent standing surface members being coupled via an intermediate coupling member with a coupling member surface that is recessed relative to the standing surface of the adjacent standing surface members; or wherein the configurable ladder system further comprises a coupling assembly having a first coupling member being disposed at a first predetermined region of a selected side rail of said first pair and being rotatably coupled with the proximal end region of said support platform, a second coupling member being disposed at a second predetermined region of the selected side rail that is separated from the first predetermined region by a preselected distance, and an elongated coupling member having a proximal end region being rotatably coupled with said second coupling member and a distal end region defining an elongated channel for receiving an extension coupling member extending from a side region of the distal end region of said support platform, the extension coupling member traveling within the elongated channel as said support platform transitions between the stowed position and the deployed position, wherein said coupling assembly includes a locking system for maintaining said support platform in the stowed position.

2. The configurable ladder system of claim 1, wherein the second lower end region is distal from the first lower end region in the step ladder configuration, the first and second lower support members engaging the base support region to support the ladder system.

3. The configurable ladder system of claim 1, wherein the second lower end region is proximal to the first lower end region in the shelf ladder configuration, the upper support member and the first lower support member being configured to engage the elevated support region and the base support region, respectively, to support the ladder system.

4. The configurable ladder system of claim 3, wherein said second pair of elongated side rails is parallel to said first pair of elongated side rails in the shelf ladder configuration, the second lower support member being distal from the base support region and not supporting the ladder system.

5. The configurable ladder system of claim 3, wherein the upper support member includes a pair of inwardly-angled engagement regions for engaging an inside corner of the elevated support region, a pair of planar engagement regions for engaging a flat surface of the elevated support region and a pair of outwardly-angled engagement regions for engaging an outside corner of the elevated support region.

6. The configurable ladder system of claim 5, wherein the pair of outwardly angled engagement regions define a channel having a stepped profile with a plurality of paired engagement surfaces for alternatively engaging a plurality of elevated support regions with respective standardized sizes.

7. The configurable ladder system of claim 6, wherein a selected pair of the paired engagement surfaces is bounded by respective opposite side surfaces and is displaced by a predetermined depth from an adjacent pair of the paired engagement surfaces.

8. The configurable ladder system of claim 7, wherein the predetermined depth is within a first range between one-eight inch and one inch, a second range between one-quarter inch and two inches, a third range between three-eighths inch and three inches or a fourth range between one-half inch and four inches.

9. The configurable ladder system of claim 7, wherein an intersection of the selected pair of the paired engagement surfaces and the respective opposite side surfaces includes a chamfered portion for engaging a round surface of the elevated support region.

10. The configurable ladder system of claim 1, wherein the upper support member includes a first non-skid surface material for enhancing the engagement with the elevated support region, wherein the first lower support member includes a second non-skid surface material for enhancing the engagement with the base support region, wherein the second lower support member includes a third non-skid surface material for enhancing the engagement with the base support region or a combination thereof.

11. The configurable ladder system of claim 1, further comprising a working cap apparatus being disposed at the first upper end region and providing the upper support member, said working cap apparatus having opposite side regions being adjacent to the respective elongated side rails in said first pair and including a pair of carabiner holders for coupling with opposite ends of a safety strap apparatus, wherein the upper support member and the safety strap apparatus are configured to capture and retain the elevated support region.

12. The configurable ladder system of claim 11, wherein the safety strap apparatus has an adjustable length for securing an engagement of the upper support member and the safety strap apparatus with a periphery of the elevated support region.

13. The configurable ladder system of claim 11, wherein said working cap apparatus includes a hardware tray, a drill holder, a pliers holder, a screwdriver holder, a tape measure holder and a magnet element for attracting ferromagnetic objects and defines a channel for supporting a selected workpiece.

14. The configurable ladder system of claim 1, wherein the predetermined distance is between two feet and four feet.

15. The configurable ladder system of claim 1, wherein the adjacent standing surface members include a pattern of raised extensions being configured to provide a physical separation between a user foot and the accumulated material, and wherein the intermediate coupling member and the adjacent standing surface members define a pattern of openings for draining the accumulated material.

* * * * *